US011839966B1

(12) United States Patent
Helmrich

(10) Patent No.: US 11,839,966 B1
(45) Date of Patent: Dec. 12, 2023

(54) BICYCLE STAND AND REPAIR APPARATUS

(71) Applicant: RAKSTAND, LLC, Montgomery, TX (US)

(72) Inventor: Christopher M Helmrich, Montgomery, TX (US)

(73) Assignee: RAKSTAND, LLC, Montgomery, TX (US)

( * ) Notice: Subject to any disclaimer, the term of this patent is extended or adjusted under 35 U.S.C. 154(b) by 346 days.

(21) Appl. No.: 17/340,812

(22) Filed: Jun. 7, 2021

Related U.S. Application Data

(60) Provisional application No. 63/036,837, filed on Jun. 9, 2020.

(51) Int. Cl.
*B25H 1/00* (2006.01)

(52) U.S. Cl.
CPC ..... *B25H 1/0014* (2013.01)

(58) Field of Classification Search
CPC ... B62H 3/00; B62H 3/02; B62H 3/04; B62H 3/06; B62H 3/08; B62H 3/10; B62H 3/12; B25B 5/147; B25H 1/0007; B25H 1/0014
USPC ..... 211/17, 18, 19, 20, 21, 22, 23, 24
See application file for complete search history.

(56) References Cited

U.S. PATENT DOCUMENTS 516,571 A 3/1894 Moulton
547,412 A * 10/1895 Boerum ..... B62H 3/12 211/17
562,669 A 6/1896 Smart
564,787 A * 7/1896 Hart ..... B62H 3/12 211/17
4,830,196 A 5/1989 Csanady
(Continued)

FOREIGN PATENT DOCUMENTS

DE 102009053165 B3 * 3/2011 ..... B62H 3/12
EP 3290309 A1 3/2018
(Continued)

OTHER PUBLICATIONS

Public Work Stand data sheet, Park Warehouse, downloaded from the Internet on May 26, 2020, at url: https://parkwarehouse.com/wp-content/uploads/2018/08/537br140-Data-Sheet.pdf.
(Continued)

*Primary Examiner* — Joshua E Rodden
(74) *Attorney, Agent, or Firm* — Jeffrey L. Wendt; THE WENDT FIRM, P.C.

(57) ABSTRACT

A bicycle stand and repair apparatus includes left and right positioning rails and left and right pivotable support bars pivotable through an angle "β" to the left and right positioning rails, with a positionable center guide generally transverse to the left and right positioning rails and connecting same. Front and rear stability bars are fixed to the left and right positioning rails. A slidable tire holder having a tire holder notch, the slidable tire holder transversely connecting the left and right pivotable support bars, the slidable tire holder positionable from distal ends of the left and right pivotable support bars. A repair mount is provided that may be temporarily stowed when the apparatus is in a stowed position or when the apparatus is used as a bicycle rack, and detachable from the stowed position and securable to the slidable tire holder and/or to the left and right pivotable support bars.

8 Claims, 14 Drawing Sheets

(56) References Cited

U.S. PATENT DOCUMENTS

| | | | | | |
|---|---|---|---|---|---|
| 4,969,642 | A * | 11/1990 | Phillips | A63B 69/16 | 482/61 |
| 5,246,120 | A * | 9/1993 | Walker | B62H 3/12 | 211/21 |
| D356,901 | S | 4/1995 | Schoenig et al. | | |
| D358,048 | S | 5/1995 | Schoenig et al. | | |
| D372,691 | S | 8/1996 | Eason | | |
| 5,979,878 | A * | 11/1999 | Blankenship | B25H 1/0014 | 254/131 |
| D556,530 | S | 12/2007 | Workman et al. | | |
| 8,413,820 | B2 | 4/2013 | Steadman et al. | | |
| D717,701 | S | 11/2014 | Hudson et al. | | |
| D718,193 | S | 11/2014 | Diorio | | |
| 8,893,897 | B2 | 11/2014 | Workman et al. | | |
| 8,944,258 | B2 | 2/2015 | Chiu | | |
| 9,145,181 | B2 | 9/2015 | Peruzzo | | |
| D780,640 | S | 3/2017 | Hudson, Jr. et al. | | |
| 9,610,993 | B1 * | 4/2017 | Ho | B62H 3/06 | |
| 9,650,092 | B1 | 5/2017 | Tsai | | |
| 9,981,706 | B2 | 5/2018 | Van Straaten et al. | | |
| 10,377,435 | B2 | 8/2019 | Montague | | |
| 10,618,582 | B1 * | 4/2020 | Liu | B62H 3/06 | |
| 10,668,866 | B2 | 6/2020 | Kuschmeader et al. | | |
| D908,048 | S * | 1/2021 | Peruzzo | D12/115 | |
| 11,008,060 | B1 * | 5/2021 | Liu | B62H 3/10 | |
| 11,312,438 | B1 * | 4/2022 | Gu | B62H 3/08 | |
| 11,505,267 | B1 * | 11/2022 | Gu | B62H 3/04 | |
| 11,708,120 | B1 * | 7/2023 | Striebel | B62H 3/12 | 211/21 |
| 2002/0117459 | A1 * | 8/2002 | Chen | B66F 3/005 | 211/20 |
| 2009/0250564 | A1 * | 10/2009 | Glover | B62H 3/04 | 410/98 |
| 2013/0270201 | A1 * | 10/2013 | Vineyard | B62H 3/12 | 211/21 |
| 2017/0120974 | A1 * | 5/2017 | Peruzzo | B62H 3/06 | |
| 2020/0324840 | A1 * | 10/2020 | Maxfield | B62H 3/06 | |
| 2021/0188186 | A1 * | 6/2021 | Rosenqvist | B60R 9/048 | |
| 2022/0306009 | A1 * | 9/2022 | Pitugnarongphor | B62H 3/00 | |

FOREIGN PATENT DOCUMENTS

| | | | | |
|---|---|---|---|---|
| GB | 2394928 | A * | 5/2004 | B62H 3/08 |
| KR | 20120050026 | A | 5/2012 | |
| KR | 483119 | Y1 * | 4/2017 | B62H 3/00 |
| KR | 484318 | Y1 * | 8/2017 | B62H 3/04 |

OTHER PUBLICATIONS

Public Work Stand Deluxe, Park Warehouse, downloaded from the Internet on May 26, 2020, at url: https://parkwarehouse.com/product/deluxe-public-work-stand-surface-mount/.

* cited by examiner

BICYCLE STAND AND REPAIR APPARATUS

CROSS-REFERENCE TO RELATED APPLICATIONS

This application is entitled to and claims the benefit of earlier filed provisional application Ser. No. 63/036,837, filed Jun. 9, 2021, under 35 U.S.C. § 119(e), which earlier filed provisional application is incorporated by reference herein in its entirety.

BACKGROUND INFORMATION

Technical Field

The present disclosure relates to apparatus and methods in the bicycle or "cycling" fields. More particularly, the present disclosure relates to apparatus useful as a bicycle stand and as a rack for storing and/or working on bicycles. By "bicycle" I mean to include not only two-wheel cycles, but also single-wheel and multi-wheel cycles, motorized and non-motorized.

Background Art

Existing bicycle stands do not always lend themselves well to the varied needs of cyclists, particularly when repairs or maintenance is needed. Most cyclists are not interested in purchasing a traditional bicycle rack because that takes up too much space, creates an eye sore, and can be costly. Currently the only products that are available are single purpose bicycle racks similar to those seen in parks, playgrounds, and schools (in other words, an apparatus where the user places a wheel of the cycle into a floor or sidewalk device with the cycle in the upright position) and bicycle repair stands (in other words, apparatus fixed to a wall, floor, or sidewalk, and where the user hangs the cycle, either by the wheel(s) or bicycle frame, or perhaps by the seat, and there may be tools available for cyclists). Even a single-bicycle traditional bicycle rack that does not take up a lot of space will not allow a cyclist to position the cycle above the floor or sidewalk in order to more easily repair or maintain the bicycle, for example, make an adjustment to a derailleur. Conversely, available bicycle repair stands must be bolted to the floor or other support, are expensive, and cannot serve as a bicycle rack and/or wall mount.

U.S. Pat. No. 516,571 describes a folding bicycle stand having a base or platform and two upright arms forming a resilient spring support. A roller engages the bicycle tire. There is no mention of a clip for hanging the structure on a mating garage door hinge or other mating clip, or providing part of the stand (fork) as a sturdy horizontal plane for placing the bicycle thereon and working on the bicycle, or an adjustable fork with screw or "twist" tightening feature that may be used as a clamp to secure the bicycle, or the QC/QDC feature for removing the fork.

U.S. Pat. No. 562,669 discloses a bicycle support characterized by a pair of near vertical arms, and front and rear base blocks. A clip is provided to secure rear base plate to the arms. There is no mention of a clip for hanging the structure on a mating garage door hinge or other mating clip, or providing part of the stand (fork) as a sturdy horizontal plane for placing the bicycle thereon and working on the bicycle, or an adjustable fork with screw tightening feature that may be used as a clamp, or the QC/QDC feature for removing the fork. As the arms are made of a single strip of wire rod or tubing bent to form the arms and horizontally-disposed members, the structure would seem too flimsy to be used to work on a bicycle.

U.S. Pat. No. 4,830,196 is not very relevant as it does not seem to disclose a structure capable of performing as a bicycle rack, but includes an upper bracket secured to a wall or upright for supporting the front wheel of the bicycle and a lower bracket located below the upper bracket and also secured to the wall for supporting the rear wheel of the bicycle. Each bracket has a first mounting position for supporting the bicycle in a vertical position perpendicular to the wall and second mounting position for supporting the bicycle in a vertical position angled less than 90 degrees from the wall. There is no mention of a clip for hanging the structure on a mating garage door hinge or other mating clip, or providing part of the stand (fork) as a sturdy horizontal plane for placing the bicycle thereon and working on the bicycle, or an adjustable fork with screw or "twist" tightening feature that may be used as a clamp, or the QC/QDC feature for removing the fork.

U.S. Pat. No. 8,413,820 discloses an interesting bicycle storage device, but unfortunately seems to need to be attached and fixed to a wall or other upstanding support structure, and does not seem to be able to perform as a bicycle rack. The device includes a base adapted to be fixed to the support, a support member connected to the base to be pivotable about a first axis which is generally level (horizontal), to be movable between a first position, at which it is adjacent to the support and a second position at which it extends laterally from the support, the support member being adapted to receive and support a bicycle when in its second position. Like other patents, the support member is described as formed from a single length of rod material which is bent to provide a pair of parallel elongate arms which are spaced from each other to provide a first space between themselves, where the free end portions of the arm at inner edges of the support member are pivotally received in a hinge housing. The other ends of the arms are outermost and are interconnected by a bridging portion which defines the outer edge of the support member. There is no mention of a clip for hanging the structure on a mating garage door hinge or other mating clip, or providing part of the stand (fork) as a sturdy horizontal plane for placing the bicycle thereon and working on the bicycle, or an adjustable fork with screw or twist tightening feature that may be used as a clamp, or the QC/QDC feature for removing the fork. Possibly, in the unfolded position, there is a horizontal plane formed and perhaps a bicycle could be placed (balanced) thereon and worked on, but the device is not easily removed from a wall or garage door by virtue of mating clips, and the structure seems too flimsy to be used to mount a bicycle thereon to make repairs to the bicycle. There are no screw-tightening features, and no QC/QDC features.

U.S. Pat. No. 8,944,258 includes a parking base having a third tubular shaft and a pair of second tubular shafts, a pair of tubular shaft jackets, a first tubular shaft having a tubular space adapted for extensible and collapsible movement of a second tubular shaft, a tubular shaft jacket disposed underneath a tubular shaft opening of the first tubular shaft, wherein outer diameter of an end of the jacket is slightly larger than outer diameter of first tubular shaft, outer diameter of a connector of another end occurs to match inner diameter of tubular shaft opening. The connector is coupled to the inner wall of the tubular shaft opening, so the second tubular shaft can be locked into an expanded portion of an end of the second tubular shaft when inserted into tubular shaft opening, to therefore effectively reduce second tubular shaft length for space conservation. There is no mention of a clip for hanging the structure on a mating garage door hinge or other mating clip or providing part of the stand (fork) as a sturdy horizontal plane for placing the bicycle thereon and working on the bicycle. The fork is adjustable, but there is no screw or twist tightening feature that may be used as a clamp, or the QC/QDC feature for removing the fork.

U.S. Pat. No. 9,650,092 features a base and a limiting device. The base has a wheel receiving frame having two elongated limiting members and two abutting members concaved with two abutting recesses respectively. An accommodating space is formed between the two elongated limiting members and between the two abutting members. The limiting device has a swinging bar, a spring, and two limiting cones installed at an end of the swinging bar in a way that peaks of the two limiting cones are pointed towards each other. When the swinging bar is swung about a pivot, a body of the swinging bar is swung correspondingly to the accommodating space and the two abutting recesses in a way that the juncture of the peaks of the two limiting cones corresponds to the accommodating space and the two abutting recesses. Although an interesting device, there is no mention of a clip for hanging the structure on a mating garage door hinge or other mating clip, or providing part of the stand (fork) as a sturdy horizontal plane for placing the bicycle thereon and working on the bicycle, or an adjustable fork with screw or "twist" tightening feature that may be used as a clamp to secure the bicycle, or the QC/QDC feature for removing the fork.

U.S. Pat. No. 9,981,706 discloses a bicycle stand which includes a frame with a first channel support and a transversely extending second channel support which are configured to engage with parts of a rim of a bicycle wheel. A knob may be used for adjusting the height of the vertical portion, and thus the height of the bicycle. There is no mention of a clip for hanging the structure on a mating garage door hinge or other mating clip, or providing part of the stand (fork) as a sturdy horizontal plane for placing the bicycle thereon and working on the bicycle, or an adjustable fork with screw or "twist" tightening feature that may be used as a clamp to secure the bicycle, or the QC/QDC feature for removing the fork. U.S. Pat. No. 10,618,582, appears to be an attempt to improve upon the device of the '706 patent, and contains at least one mounting, at least one groove, and at least one rotatable connection portion. Two rotatable connection portions are parallelly arranged on each of two ends of the at least one groove, and each of the two rotatable connection portions is rotatably connected with each of multiple dampers. Each clamper has a coupling portion for mating with each rotatable connection portion, a fixing shaft is connected with each rotatable connection portion and the coupling portion, and the fixing shaft is inserted through a resilient element. The resilient element has two first returning segments, each damper has an arcuate face parallel to each rotatable connection portion, and each damper has a receiving portion formed on the arcuate face beside each of two sides of each groove. There is no mention of a clip for hanging the structure on a mating garage door hinge or other mating clip, or providing part of the stand (fork) as a sturdy horizontal plane for placing the bicycle thereon and working on the bicycle, or an adjustable fork with screw or "twist" tightening feature that may be used as a clamp to secure the bicycle, or the QC/QDC feature for removing the fork.

Published US patent application US 2017/0120974 discloses a "bicycle floor rack" including a resting base with a positioning opening for a wheel of a bicycle or the like, and a fall arrester fork, which is extended upward, in the active configuration, from the resting base, and is adapted to prevent the lateral fall of a wheel inserted therein. The resting base is made of plastic material. The fork is pivoted to the base and configured to be arranged either in an inactive configuration, lowered onto the resting base, or in an active configuration, rotated upward. The floor rack further includes reversible elements for locking the fall arrester fork in the active configuration. There is no mention of a clip for hanging the structure on a mating garage door hinge or other mating clip, or providing part of the stand (fork) as a sturdy horizontal plane for placing the bicycle thereon and working on the bicycle, or an adjustable fork with screw or "twist" tightening feature that may be used as a clamp to secure the bicycle, or the QC/QDC feature for removing the fork.

EP3290309A1 discloses a stand arrangement that is free-standing and self-supporting, so that the bicycle stand can be positioned anywhere in a room or on an open space. The stand is adjustable in width and height. A claw feature engages the front tire. There is no mention of a clip for hanging the structure on a mating garage door hinge or other mating clip, or providing part of the stand (fork) as a sturdy horizontal plane for placing the bicycle thereon and working on the bicycle. The claw engages the front tire to stabilize the bicycle, but the bicycle is vertical, not horizontally positioned. There is no QC/QDC feature for removing the fork.

KR20120050026 discloses a bicycle rack that allows a bicycle to be hung from the rack. The carrier includes a fixing plate member having a pair of upper and lower hinge fixing brackets to fix the hinge pins on the plate leading up and down; a mounting frame having a pair of left and right support frames spaced apart from each other by a predetermined width so as to mount the front wheel of the bicycle, and connected to the pin fixing tube through which the hinge pin is supported; and an installation angle adjustment member provided on the fixing plate member and configured to maintain an installation angle of the mounting frame to maintain a fixed state. There is no mention of a clip for easily hanging and removing the structure on a mating garage door hinge or other mating clip, or providing part of the stand (fork) as a sturdy horizontal plane for placing the bicycle thereon and working on the bicycle, or an adjustable fork with screw or "twist" tightening feature that may be used as a clamp to secure the bicycle, or the QC/QDC feature for removing the fork.

Cyclist safety is of utmost concern. Without the availability of easy-to-use, inexpensive bicycle racks that may be converted into sturdy bicycle stands, cyclists will often avoid or delay repairing or maintaining their bicycles with the potential for accidents and injury to cyclists therefore increasing.

As may be seen, currently available bicycle stands and methods of using them may not be adequate for all circumstances, and at worst may result in injury to cyclists. There remains a need for more safe, robust bicycle stand apparatus allowing standing, storing and working on bicycles that reduce exposure of cyclists to potential injury due to lack of maintenance on bicycles. The apparatus and methods of the present disclosure are directed to these needs.

SUMMARY

In accordance with the present disclosure, bicycle stand and repair apparatus are presented that reduce or overcome many of the shortcomings of previous devices. Providing a bicycle stand that doubles as a bicycle repair stand (sometimes referred to as a "rack", "repair rack", or "storage rack") saves space, eliminates the eye sore and is more cost effective. With a clip or other mechanism located on the bottom of the bicycle stand, the stand converts into an immediate repair station or other work station when the need arises providing a substantially horizontal (or non-horizontal) plane allowing a person to make any and all necessary adjustments from a standing or comfortable sitting position. The bicycle stand can be mounted on any garage hinge at the persons desired height. Also, with a backing plate the bicycle stand can be mounted at any location that a person chooses if mounting on the garage hinge is not ideal. When the user is finished making the necessary adjustments to the bicycle, the user simply unclips the apparatus from the hinge or other mating clip and returns it to the bicycle stand position, where the fork arms are substantially vertical.

A bicycle stand and repair apparatus comprising:

a frame base defining a space for accommodating a first portion of a bicycle wheel or tire of a bicycle;

a fork attached to the frame base and extending away therefrom substantially vertically when the frame base is on a substantially horizontal surface;

an adjustment mechanism (or knob) on the fork providing a tighten/untighten feature for securing a bicycle to the fork, the adjustment mechanism positioned on the fork distal from the frame base (in some embodiments the adjustment mechanism may be simply a twist-to-tighten/untighten feature for the fork, or may simply be a clamp that tightens (or locks) and untightens (or unlocks) by user action, similar to the clamp lever that locks a front wheel onto a road bicycle); and a clip attached to a lower front portion of the frame base.

In certain embodiments the frame base may comprise:

a front cross bar connecting a left front leg and a right front leg;

a rear cross bar connecting a left rear leg and a right rear leg;

a left-side angled support bar and a right-side angled support bar connecting the front cross bar and the rear cross bar, an angle "α" is made by the left front leg and the left-side angled support bar, and the same angle "α" is made by the right front leg and the right-side angled support bar, the angle "α" ranging from about 90 degrees to about 175 degrees.

In certain embodiments the clip may be attached to a lower front portion of the front cross bar, the clip positioned and having a shape allowing it to grasp a mating clip or other structure and stabilize the apparatus when the weight of a bicycle is on the apparatus.

In certain embodiments the base frame includes a left front foot comprising a distal end of the left front leg, a right front foot comprising a distal end of the right front leg, a left rear foot comprising a distal end of the left rear leg, and a right rear foot comprising a distal end of the right rear leg.

In certain embodiments:

the fork may comprise left and right fork arms and a slidable fork support bar connecting them, the slidable fork support bar having left and right portions, one of the left and right portions slightly smaller in outer diameter than an inner diameter of the other, so that the slightly smaller outer diameter portion slides inside the inner diameter of the other, the left fork arm having a similar arrangement of diameters with a left arm socket, and the right fork arm having a similar arrangement of diameters with a right arm socket.

In certain embodiments the adjustment knob/locking mechanism may be configured to allow placement of the bicycle onto the apparatus and stabilize the bicycle by tightening the left and/or right fork arms by moving them toward each other and grasping the bicycle between a left bicycle socket at a distal end or top of the left fork arm and a right bicycle socket at a distal end or top of the right fork arm. In certain embodiments the left and right fork arms may be adjustable in vertical height (or horizontal length) via left and right fork arm quick connect/quick disconnect (QC/QDC) features. The left and right fork arms may be removable from the apparatus via left and right fork arm quick connect/quick disconnect (QC/QDC) features. The frame base and fork may comprise solid cylinders or hollow cylinders or tubes. The clip may be attached to the front portion of the frame base by a weld, a braze, a rivet, a screw, or forged with the frame base. The clip may be a piece of angle iron, positioned so that a first leg of the angle iron extends slightly forward from the frame base, and a second leg of the angle iron extends substantially perpendicularly downward in relation to the first leg. In certain embodiments the clip may have a shape selected from curvilinear and polygonal.

A bicycle stand and repair apparatus comprising:

an adjustable frame base defining a space for accommodating a first portion of a bicycle wheel or tire of a bicycle;

a fork comprising left and right fork arms slidably engaged with a track in the adjustable frame base and extending away therefrom substantially vertically when the adjustable frame base is on a substantially horizontal surface;

an adjustment mechanism on the fork providing a tighten/untighten feature for the left and/or right fork arms and the adjustable frame base to expand/contract the apparatus and allow different sizes of bicycle wheels and tires to fit in the space, the adjustment mechanism positioned on the fork distal from the adjustable frame base; and a clip attached to a lower front portion of the adjustable frame base.

In certain embodiments the adjustable frame base may comprise:

an adjustable front cross bar connecting a left front leg and a right front leg;

an adjustable rear cross bar connecting a left rear leg and a right rear leg;

a left-side angled support bar and a right-side angled support bar connecting the adjustable front cross bar and the adjustable rear cross bar, an angle "α" is made by the left front leg and the left-side angled support bar, and the same angle "α" is made by the right front leg and the right-side angled support bar, the angle "α" ranging from about 90 degrees to about 175 degrees, and the clip is attached to a lower front portion of the front cross bar, the clip positioned and having a shape allowing it to grasp a mating clip or other structure and stabilize the apparatus when the weight of a bicycle is on the apparatus.

In certain embodiments the adjustable base frame may include a left front foot comprising a distal end of the left front leg, a right front foot comprising a distal end of the right front leg, a left rear foot comprising a distal end of the left rear leg, and a right rear foot comprising a distal end of the right rear leg.

In certain embodiments:

the adjustable fork may comprise a slidable fork support bar connecting the left and right fork arms, the slidable fork support bar having left and right portions, one of the left and right portions slightly smaller in outer diameter than an inner diameter of the other, so that the slightly smaller outer diameter portion slides inside the inner diameter of the other, the left fork arm having a similar arrangement of diameters with a left arm socket, and the right fork arm having a similar arrangement of diameters with a right arm socket.

In certain embodiments the adjustment mechanism or knob may be configured to allow placement of the bicycle onto the apparatus and stabilize the bicycle by tightening the left and/or right fork arms and the adjustable frame base by moving them toward each other and grasping the bicycle between a left bicycle socket at a distal end or top of the left fork arm and a right bicycle socket at a distal end or top of the right fork arm.

In certain embodiments the left and right fork arms may be adjustable in vertical height (or horizontal length) via left and right fork arm quick connect/quick disconnect (QC/QDC) features. In certain embodiments the adjustable frame base and fork may comprise solid cylinders or hollow cylinders or tubes.

Certain embodiments may comprise left and right positioning rails and left and right pivotable support bars, with a positionable center guide component generally transverse to the positioning rails and connecting same, with front and rear stability bars fixed to the positioning rails. In these embodiments, a slidable tire holder having a tire holder notch may be provided transversely connecting the pair of pivotable support arms, the tire holder positionable from distal ends of the pivotable support bars. Certain embodiments may comprise a repair mount that may be temporarily stowed when the apparatus is used as a bicycle rack, then detached from the stow position and secured to the slidable tire holder and/or to the left and right pivotable support bars. In certain embodiments the repair mount may comprise a knob with a threaded rod that is threaded through a female threaded chamber of a stationary clamp of the repair mount and secured to an adjustable clamp of the repair mount. Certain embodiments may comprise left and right stow clamps for securing the pivotable support bars to respective positioning rails, while the positioning rails may each comprise adjustment detents or through-holes for positioning or repositioning the pivotable support bars, the latter secured to left and right arcuate brackets that are in turn secured in slots in the center guide. The arcuate brackets may comprise one or more, or two or more positioning detents or through-holes that work with one or two support arm locking pin(s). Certain embodiments may comprise one or two positioning locking pin(s) that work with the aforesaid detents or through-holes in positioning rails. The positioning pin(s) and locking pin(s) may be supported by a support bracket welded or molded into the center guide. Certain embodiments may comprise one or more slots machined or molded into bottoms of the front and rear stability bars to accept wedges, bolts, or other mechanism to temporarily attach the apparatus to a wall, fence, garage door, or other structure. In certain embodiments the pivotable support bars may be telescoping, each employing twist locking/twist unlocking mechanisms, and where the distal sends of the support bars are connected by a transverse connector, similar to a suitcase handle.

The embodiments in the immediately preceding paragraph differ from other embodiments by, among other features, employing a small bracket or clip located on wall. The device basically slides down over a wall-mounted clip/bracket, and locks in place by use of a push/pull pin, ball detent and or some other mechanical means. The clip/bracket is designed with an angle so the device is able to be attached to wall/surface without scratching/damaging the area. Apparatus are adjustable in height while attached to a wall or other support to accommodate different standing/working positions while working on a bicycle. These apparatus embodiments also include a locking mechanism/clamp (repair mount) attached to/held in place by a lock/ball detent on device. These embodiments of the apparatus may be folded down and locked in place for storage/transport. Additionally, the apparatus have an adjustable wheel or tire mount, adjustment accomplished either by sliding the mount along the support bars or by use of locking/unlocking telescopic support bars (similar to those used in hiking/trekking poles) to accommodate different wheels and tire sizes, and so that the support bars are adjustable in length telescopically or by a slide mechanism when on ground or wall position. While attached to wall, the support bars (when positioned horizontally) or forks (when in vertical position) retract telescopically or by slide mechanism. Reduction in length of fork/support bars provides more durability/strength of forks for attaching/hanging bicycle. "Vertical" forks can be tilted/adjusted at 30, 45, 60 and 90 degree angle as illustrated herein to accommodate different size bicycles and avoid scratching of the bicycle frame while device is attached to wall while being used as a wall-mounted storage rack. The apparatus is adjustable vertically and horizontally on rods for better wheel placement/securing. In certain embodiments the center guide is slidable vertically (when the device is positioned on a wall or other support) and horizontally (when the device is functioning as a bicycle rack). In certain embodiments the center guide may further include a cutout for securing/placement of tires/wheels, providing for less movement while bicycle/tire/wheel is being held in a vertical or horizontal position.

As used herein "substantially" in the context of "substantially horizontal" and "substantially vertical" means differing from horizontal or vertical by no more than a few degrees, where a few degrees may be as much as about 5 degrees, or as much as about 10 degrees, or as much as about 25 degrees. "About" means plus or minus 2 degrees.

These and other features of the apparatus of this disclosure will become more apparent upon review of the brief description of the drawings, the detailed description, and the claims that follow. It should be understood that wherever the term "comprising" is used herein, other embodiments where the term "comprising" is substituted with "consisting essentially of" are explicitly disclosed herein. It should be further understood that wherever the term "comprising" is used herein, other embodiments where the term "comprising" is substituted with "consisting of" are explicitly disclosed herein. Moreover, the use of negative limitations is specifically contemplated; for example, certain apparatus may comprise a number of physical components and features but may be devoid of certain optional hardware and/or other features.

BRIEF DESCRIPTION OF THE DRAWINGS

The manner in which the objectives of this disclosure and other desirable characteristics can be obtained is explained in the following description and attached drawings in which.

Figure 1:
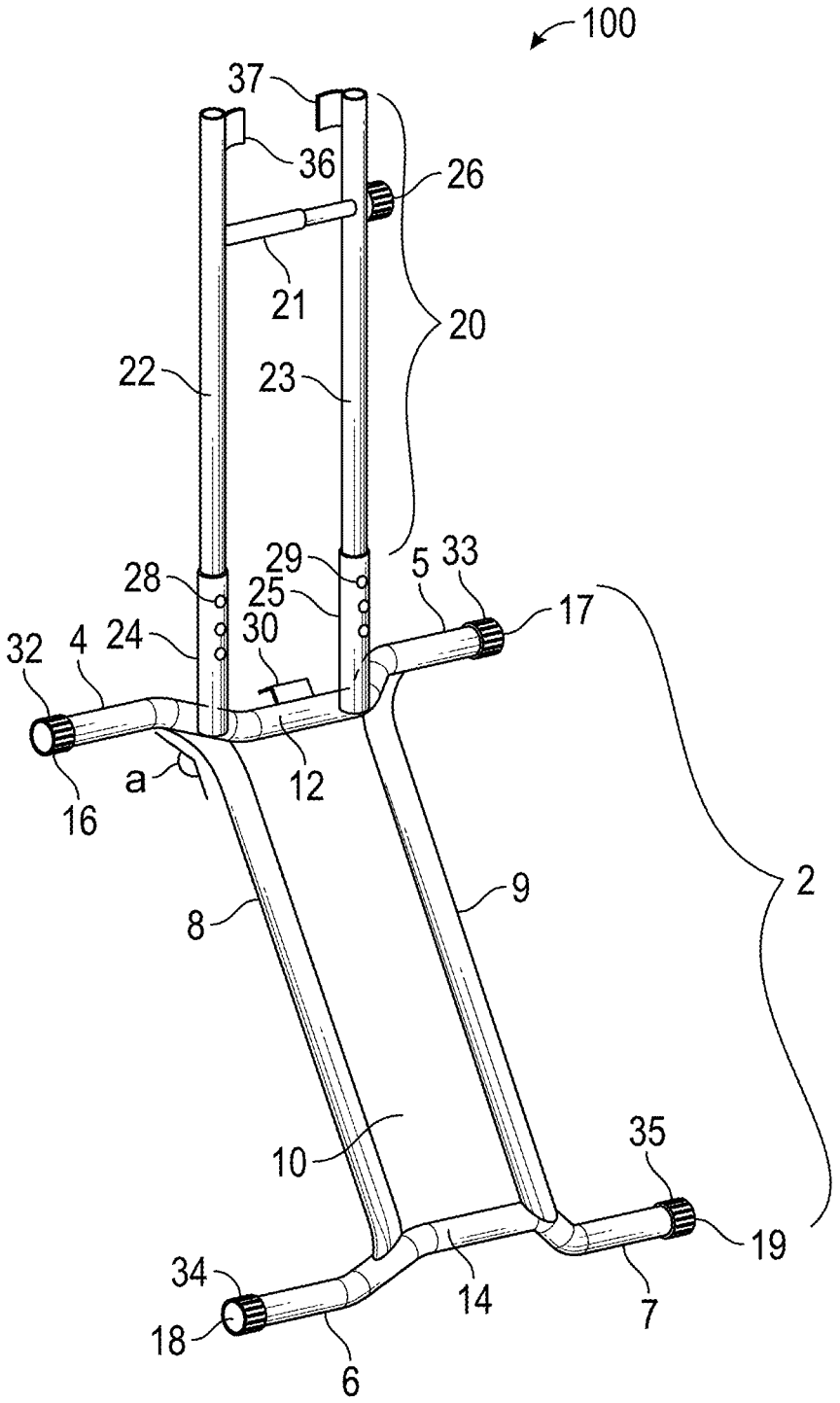
FIG. 1 is a schematic perspective view.

It is to be noted, however, that the appended drawings of FIGS. 1-25 may not be to scale and illustrate only typical apparatus embodiments of this disclosure. Therefore, the drawing figures are not to be considered limiting in scope, for the disclosure may admit to other equally effective embodiments. Identical reference numerals are used throughout the several views for like or similar elements.

DETAILED DESCRIPTION

In the following description, numerous details are set forth to provide an understanding of the disclosed apparatus, combinations, and methods. However, it will be understood by those skilled in the art that the apparatus, combinations, and methods disclosed herein may be practiced without these details and that numerous variations or modifications from the described embodiments may be possible. All U.S. published patent applications and U.S. patents referenced herein are hereby explicitly incorporated herein by reference, irrespective of the page, paragraph, or section in which they are referenced. Where a range of values describes a parameter, all sub-ranges, point values and endpoints within that range or defining a range are explicitly disclosed herein.

Apparatus of the present disclosure allow both storage of a bicycle, as in a traditional bicycle stand, wall mount as well as repair and maintenance of the bicycle by easy conversion to a repair stand.

Figure 2:
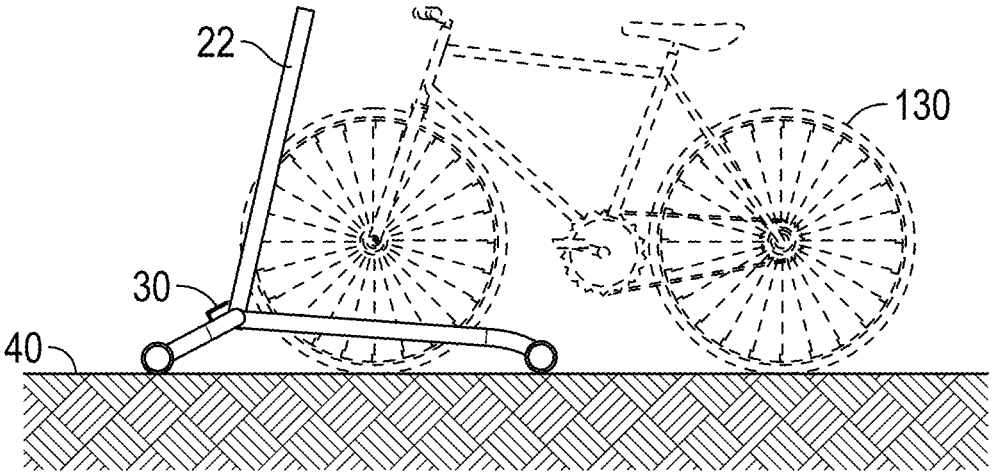
FIGS. 2 and 3 are schematic side elevation views, of one embodiment of the present disclosure.
Figure 3:
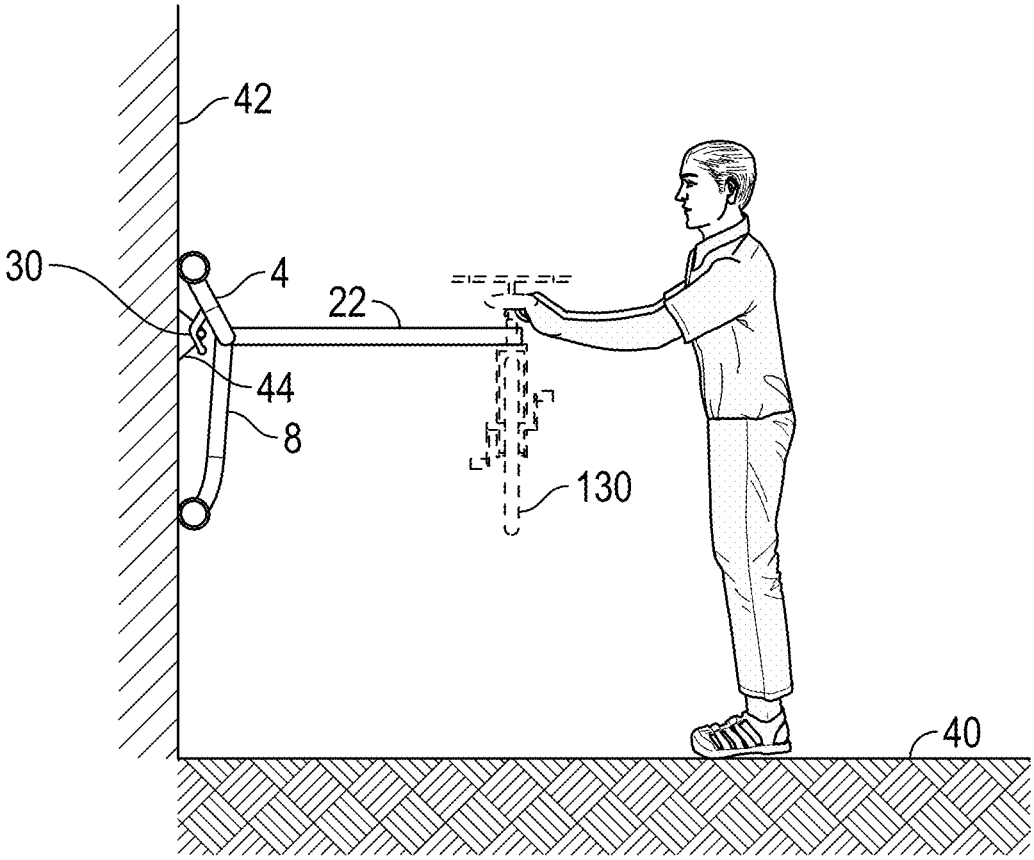

One embodiment 100 of apparatus of this disclosure is illustrated in schematic perspective view in FIG. 1, and in schematic side elevation views in FIGS. 2 and 3. Some components that are obscured from view are illustrated with dotted lines or phantom lines. The apparatus illustrated schematically in FIGS. 1-3 includes a frame base 2, in some embodiments sometimes referred to herein as simply a base or a frame having left front leg 4 and right front leg 5, left rear leg 6, and right rear leg 7, a left-side angled support bar 8, and a right-side angled support bar 9. An angle "α" is made by left front leg 4 and left-side angled support bar 8, and the same angle "α" is made by right front leg 5 and right-side angled support bar 9. Angle "a" may range from about 90 degrees to about 175 degrees, or from about 100 to about 150 degrees. A space 10 for bicycle wheels or tires between support bars 8 and 9 is thus provided. A front cross bar 12 and a rear cross bar 14 are provided, and in this embodiment 100 may be solid cylinders or hollow cylinders or tubes and are non-adjustable in length. A pair of front feet, 16 (left) and 17 (right), and a pair of rear feet 18 (left) and 19 (right) complete the base frame of embodiment 100.

Still referring to FIGS. 1-3, the apparatus comprises a fork 20, which includes left and right fork arms 22, 23, respectively, and a slidable fork support bar 21 connecting them near an upper portion of each. Slidable fork support bar 21 simply has one of the portions of fork arms 22, 23 slightly smaller in outer diameter than an inner diameter of the other, so that one portion slides within the other. Left fork arm 22 has a similar arrangement of diameters with a left arm socket 24, and right fork arm 22 has a similar arrangement of diameters with a right arm socket 25. An adjustment mechanism 26 provides a twist-to-tighten/untighten feature, allowing a cyclist to place a bicycle onto the apparatus, as illustrated schematically in FIG. 3, and stabilize the bicycle by tightening fork arms 22, 23 (moving them toward each other and grasping the bicycle between left bicycle socket 36 (at top of fork arm 22) and right bicycle socket 37 (at top of fork arm 23). The adjustment mechanism may be a knurled metal knob or rubber knob surrounding a nut that engages a bolt passed through slidable fork support bar 21 and fork arms 22, 23. Fork arms 22, 23 are adjustable in vertical height (or horizontal length) via quick connect/quick disconnect (QC/QDC) features 28, 29. Forks arms 22, 23 may also be completely removed from the apparatus, explained in reference to FIG. 5. Optionally, non-slip foot covers may be added as illustrated in FIGS. 1 at 32, 33, 34, and 35, (front left, front right, rear left, and rear right, respectively) such as resilient or hard rubber caps.

Figure 6:
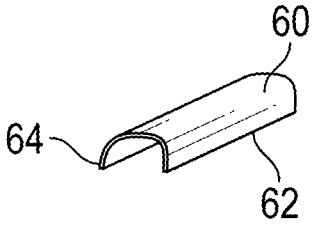
FIGS. 6 and 7 are schematic perspective views of two other clip embodiments useful with apparatus embodiments of the present disclosure.
Figure 7:
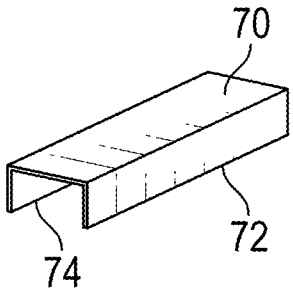

An important feature of apparatus embodiment 100 of the present disclosure is clip 30, which may be welded, brazed, riveted, screwed to, or forged to front cross bar 12. In embodiment 100, clip 30 is simply a piece of angle iron, positioned so that one side of the angle iron extends slightly forward from front cross bar 12, and the second leg extends substantially at 90 degrees downward in relation to the first leg. Clip 30 need not be a 90 degree piece, but could for example take many shapes, such as cylindrical or curvilinear, as illustrated in FIG. 6. As long as clip 30 has a shape allowing it to grasp a mating clip or other structure, and stabilize the apparatus, especially when the weight of the bicycle is on the apparatus in the position illustrated in FIG. 3, that is all that is desired. More rugged or sturdy clips 30 may be used, but that would probably add unnecessary cost to the device without adding function or safety.

As illustrated schematically in the side elevation views of FIGS. 2 and 3, apparatus of this disclosure may be function both as a bicycle stand (FIG. 2) on a floor 40, sidewalk, or other substantially horizontal support, and as a bicycle repair stand or bicycle workstation (FIG. 3). FIG. 2 illustrates schematically a bicycle in phantom with a lower portion of its front tire/wheel assembly positioned in space 10 (FIG. 1) and with a forward portion of its tire/wheel assembly positioned between fork arms 22, 23 (only left fork arm 22 is viewable in FIGS. 2 and 3). Due to the adjustable nature of fork arms 22, 23, and the fact that the apparatus may be temporarily attached to a wall or garage door 42 at home, or to a park building wall, school wall, office wall, or other facility by virtue of clip 30, and a mating clip or even a garage door hinge 44, cyclists of all ages and heights may comfortably and safely attend to repairs or maintenance of the their bicycle, without the expense of having to purchase both a bicycle stand and a bicycle repair stand.

Figure 4:
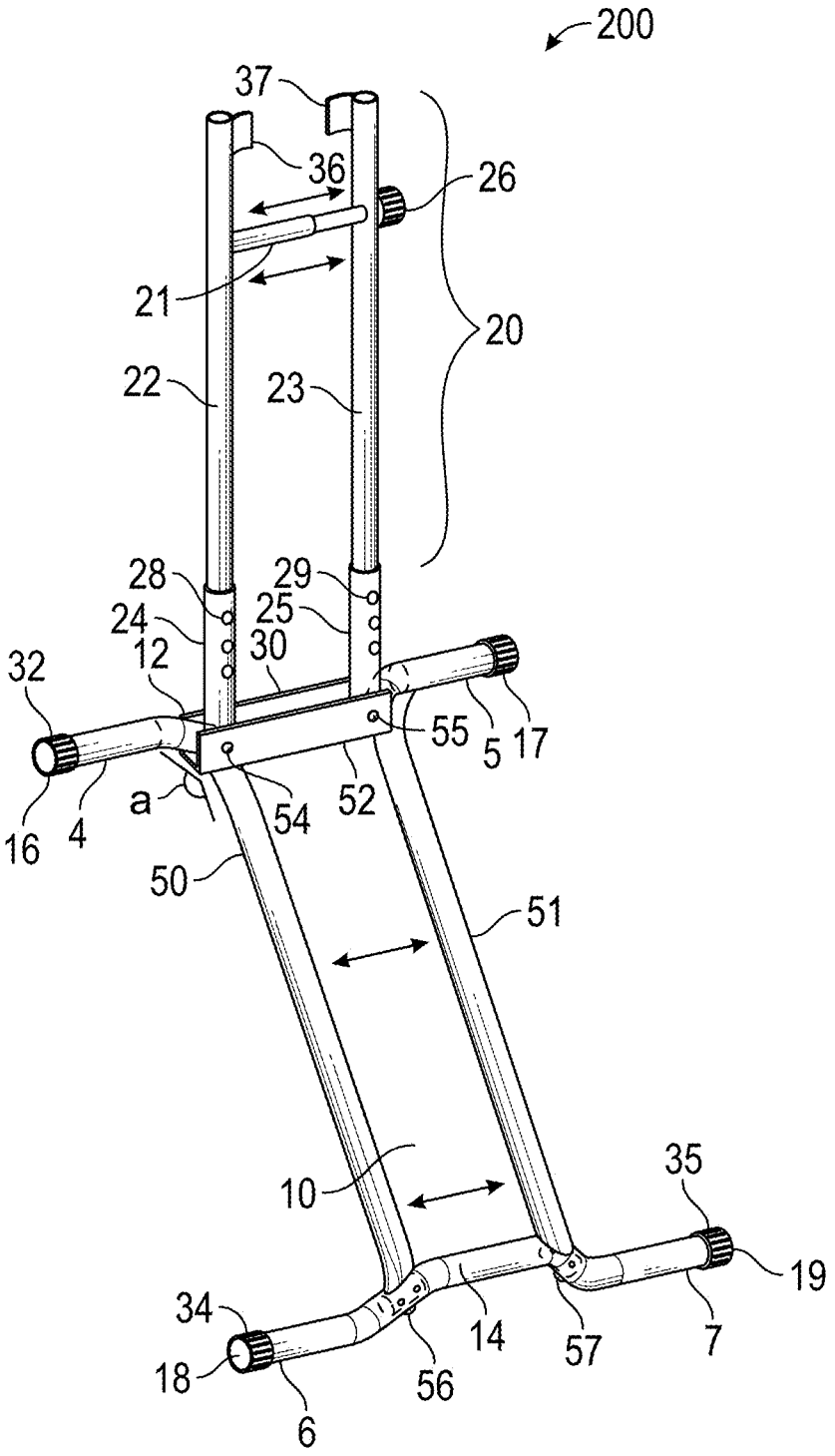
FIG. 4 is a schematic perspective view of another embodiment of the present disclosure.

FIG. 4 illustrates schematically in perspective view one of the many other possible, non-limiting embodiments of apparatus of the present disclosure. Embodiment 200 differs from embodiment 100 primarily in having further adjustment mechanisms. A left-side frame base 50 and a right-side frame base 51 are forged as a single piece, or welded to front cross bar 12 and rear cross bar 14, and in this embodiment are hollow tubular structures, so that portions of legs 4, 5, 6, and 7 may fit snuggly therein, as illustrated in phantom in FIG. 4. Adjustment holes and complementary bolts 54, 55, 56, and 57 allow width adjustment of the apparatus to accommodate various bicycle tire widths, as indicated by the double-headed arrows. Another difference from embodiment 100 is that in embodiment 200, fork arms 22, 23 may slide laterally in a fork arm track 52 to also accommodate various bicycle tire widths. This slide-ability feature is controlled by adjustment knob 26.

Figure 5:
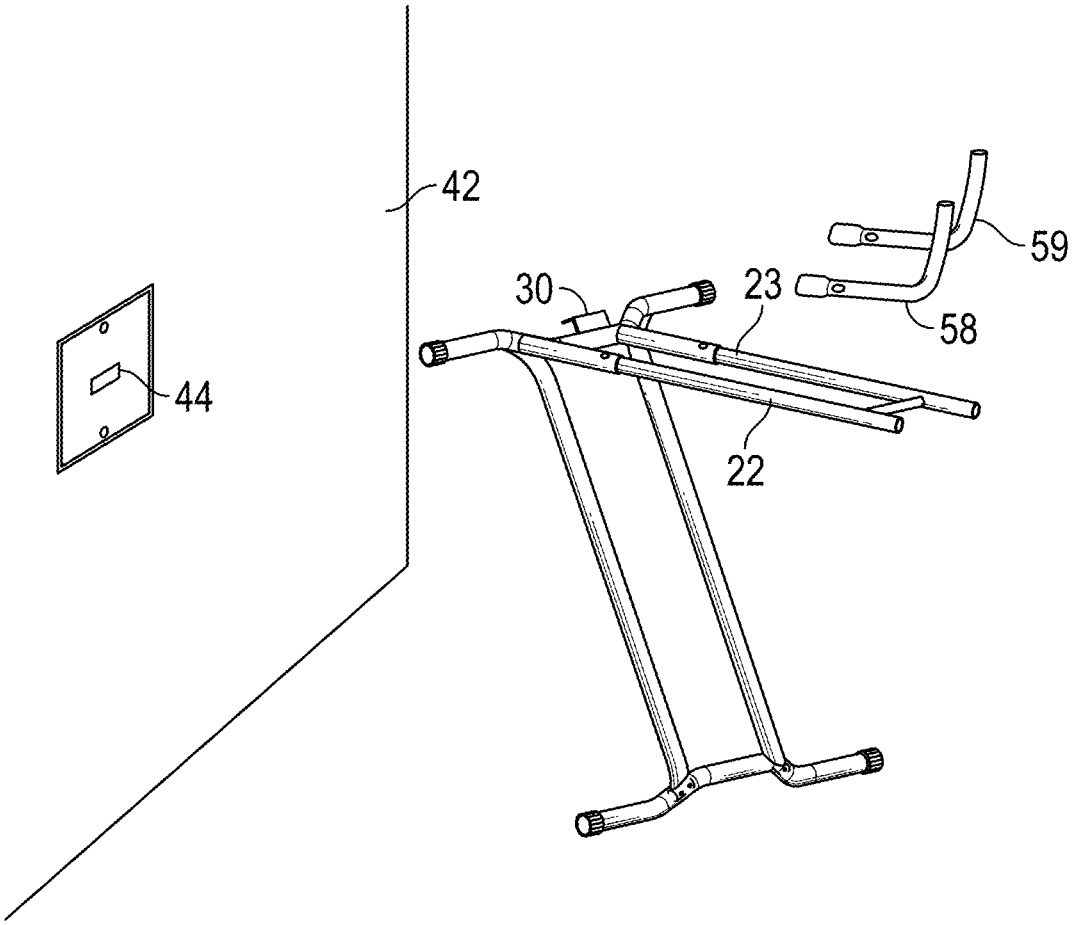
FIG. 5 is a schematic exploded perspective view illustrating how fork arms of apparatus may be exchanged for rack support members.

FIG. 5 is a schematic exploded perspective view, illustrating that fork arms 22, 23 may be removed and replaced by a left wall rack attachment "L" 58, and a right wall rack attachment "L" 59. Wall rack attachments may have any of a variety of shapes, and this is but one non-limiting example. They could for example be "half-U" shaped, triangular, or other shape. Wall attachment may include features to reduce or prevent bicycles form sliding thereon, such as rubber coatings, upright pegs, creases, and the like.

Figure 8:
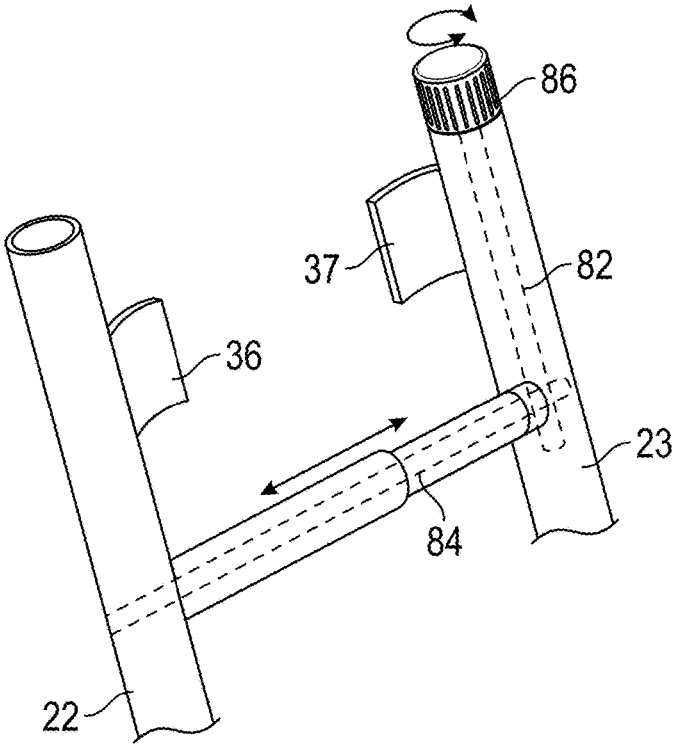
FIG. 8 illustrates schematically, partially in phantom, an alternative adjustment mechanism.

FIG. 6 illustrates in schematic perspective view a cylindrical clip 60, where one edge 62 would be fastened to front cross bar 12 by welding, brazing, screwing, bolting, riveting, and the like, or forged as a single piece with front cross bar 12. Another edge 64 serves to grab or mate with a corresponding feature on a wall or garage door hinge, as explained herein. Clips may be curved, curvilinear, cylindrical, or have linear or polygonal features, such as illustrated schematically in FIG. 7, which illustrates a "open box" shaped clip 70 having edges 72 and 74 similar in function to edges 62, 64 of the cylindrical clip illustrated schematically in FIG. 6. FIG. 8 illustrates schematically a variation of the adjustment mechanism, in this case an adjustment knob 86 positioned at the distal end of fork arm 23 surrounding a head of a threaded bolt 82 that passes down through fork arm 23. The bolt has teeth that engage a rack 84 in rack and pinion arrangement. The external diameter of adjustment knob 86 is the same as the external diameter of fork arm 23 to provide an ergonomic look. As adjustment knob 86 is tightened (turned clockwise) the bolt also turns clockwise and the rack and pinion arrangement causes fork arms 22, 23 to move together. Turning adjustment knob 86 counterclockwise loosens the fork arms. (A similar arrangement could be used on fork arm 22 rather than fork arm 23.) This is but one possible alternative adjustment mechanism.

Frame base components, fork arms, cross bars, legs, feet, support bars, positioning rails, brackets, repair mounts, and clips may be made of a suitably strong material, such as 304 or 316 stainless steel or other steel alloy; rigid plastic such as polycarbonate, polyvinyl chloride (PVC), high and low density polyethylene, and polypropylene; and composite materials such as fiber-reinforced polymers (FRP), where the fibers may be glass, carbon, aramid, or basalt. In certain embodiments all components comprise the same or similar material, for example all carbon steel or all stainless steel, but this is not strictly necessary. Frames, fork arms, support bars, and positioning rails may be solid or hollow tubular pieces, I-beams, rectangular or triangular hollow beams, rectangular or triangular solid beams, hollow D-beams, X-beams, and the like, and combinations thereof, depending on the embodiment and features desired.

In certain embodiments, more than four legs may be present. Frame bases could comprise other designs, for example, but not limited to designs having six frame legs, or having strengthening brackets or support struts (such as connecting legs 4 and 5, or connecting legs 6 and 7), or a circular base frame, where the ends of legs 4 and 6 are extended and connect to form a left-side frame base semi-circle, and similarly the legs 5 and 7 are extended and connect to form a right-side frame base semi-circle. In the same way other embodiments may feature the frame base being rectangular, triangular, polygonal, such as rectangular, or triangular, or diamond shaped.

In embodiments 100 and 200, and other embodiments, rather than rubber caps 32, 33, 34, 35, the underside of each leg may have an elastomeric pad attached thereto to provide the non-slip feature.

While a perfectly level frame 2 is not necessary, frame base 2 may be leveled by adjusting height of one or more of legs 4, 5, 6, and/or 7. Leg height adjustment may be made through either an adjustment device integral to one or more legs 4, 5, 6, and/or 7 (such as by adding screw adjusters as are typically present for a clothes washing machine) or by adding and/or removing "shim like" parts from underneath the necessary leg.

Figure 9:
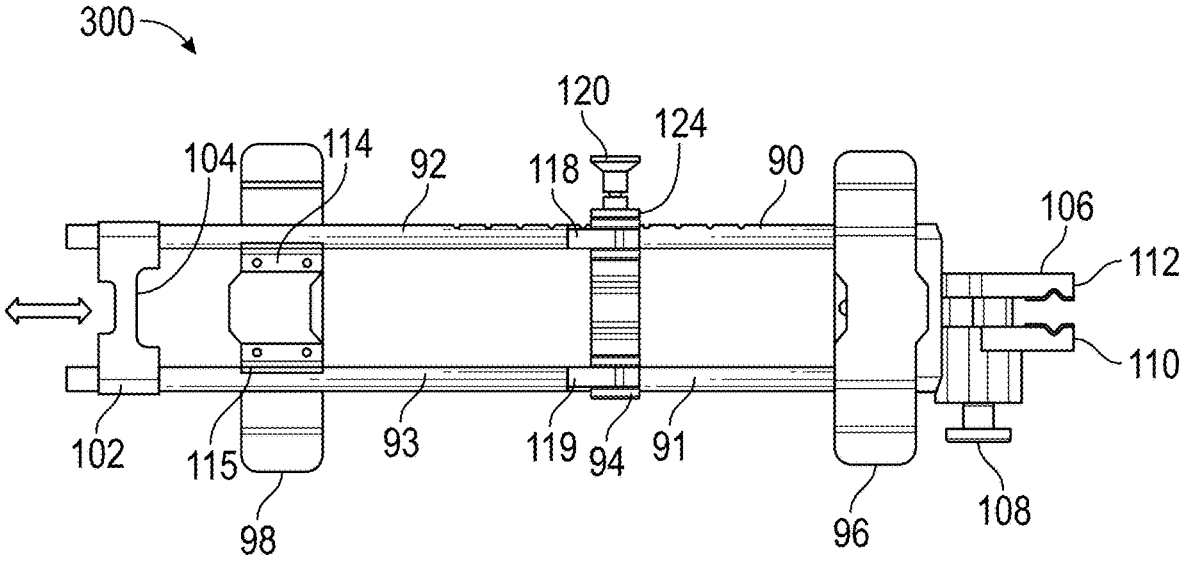
FIGS. 9, 10, and 11 are schematic plan, side elevation, and end elevation views of another apparatus embodiment in accordance with the present disclosure.
Figure 10:
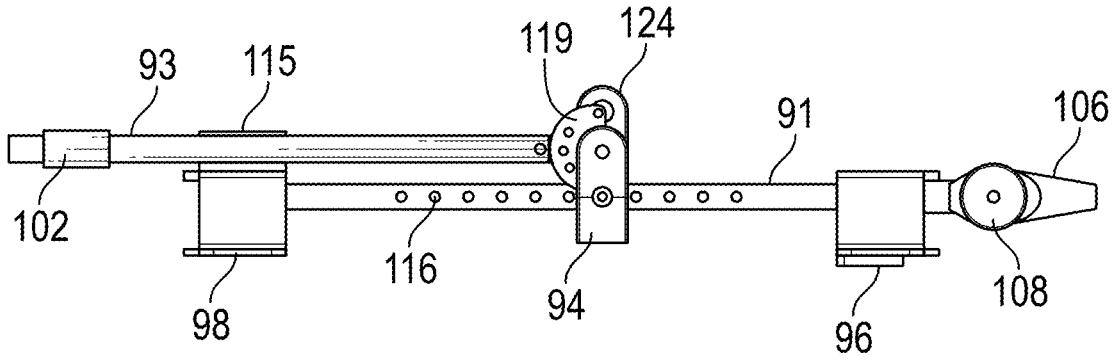
Figure 11:
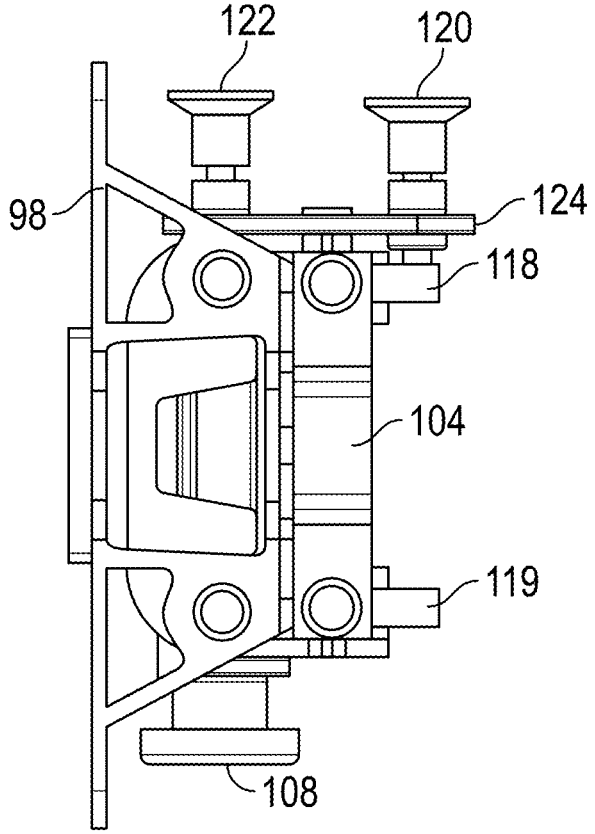

FIGS. 9, 10, and 11 are schematic plan, side elevation, and end elevation views of another apparatus embodiment 300 in accordance with the present disclosure. Embodiment 300 features left and right positioning rails 90, 91 and left and right pivotable support bars 92, 93, with a positionable center guide component 94 generally transverse to positioning rails 90, 91 and connecting same, with front and rear stability bars 96, 98 fixed to positioning rails 90, 91. It will be understood that the terms "left", "right", "front", "rear", "upper, and "lower" are merely examples for enabling description of the apparatus. Embodiment 300 further includes a slidable tire holder 102 having a tire holder notch 104. Slidable tire holder 102 transversely connects pivotable support arms 92, 93, tire holder 102 positionable from distal ends 126, 127 (FIG. 12) of pivotable support bars 92, 93. Embodiment 300 further comprises a repair mount 106 that may be temporarily stowed when the apparatus is in the stowed position as illustrated schematically in FIGS. 9-11 and 12, and when the apparatus is used as a bicycle stand as illustrated schematically in FIG. 13. Repair mount 106 is then detached from the stow position and secured to slidable tire holder 102 and/or to left and right pivotable support bars 92, 93. In certain embodiments repair mount 106 may comprise a knob 108 with a threaded rod 109 (FIG. 18) that is threaded through a female threaded chamber 111 of a stationary clamp 110 of repair mount 106 and secured to an adjustable clamp 112 of repair mount 106. Embodiment 300 further comprises left and right stow clamps 114, 115 for securing pivotable support bars 92, 93 to rear stability bar 98, while positioning rails 90, 91 each comprise adjustment detents or through-holes 116 for positioning or repositioning pivotable support bars 92, 93, the latter secured to left and right arcuate brackets 118, 119 that are in turn secured in slots in center guide 94. Arcuate brackets 118, 119 may comprise one or more, or two or more positioning detents or through-holes that work with one or both support bars 92 93 and one or two positioning locking pin(s) 120 that work with the aforesaid detents or through-holes in arcuate brackets 118, 119. Positioning pin(s) 122 and locking pin(s) 120 are supported by a support bracket 124 welded to or molded into center guide 94. Embodiment 300 further comprises one or more slots machined or molded into bottoms of front and/or rear stability bars 96, 98 to accept wedges, bolts, or other mechanism installed in a wall or other structure to temporarily attach the apparatus to the wall, fence, garage door, or other structure.

Figure 12:
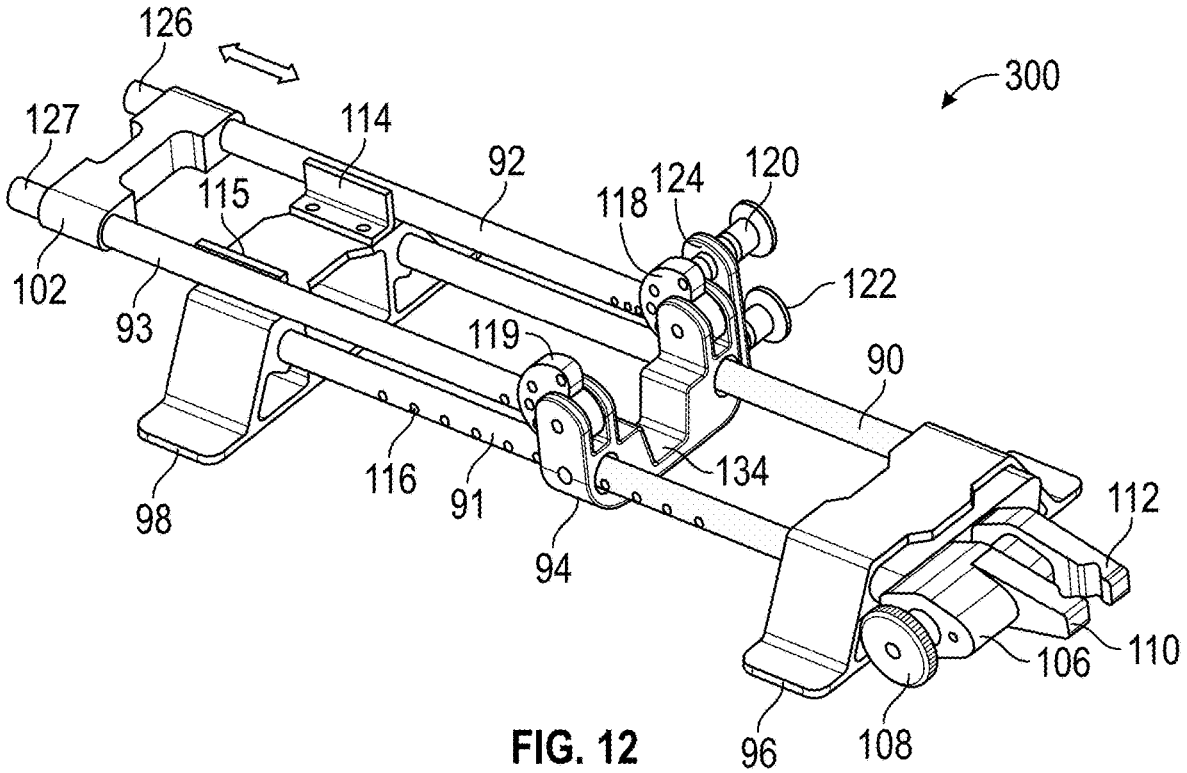
FIGS. 12 and 13 are schematic perspective views of the apparatus of FIGS. 9, 10, and 11, with FIG. 12 illustrating left and right support bars in the stowed and locked position, and FIG. 13 illustrating the support bars locked in position suitable for receiving a bicycle tire or wheel.
Figure 13:
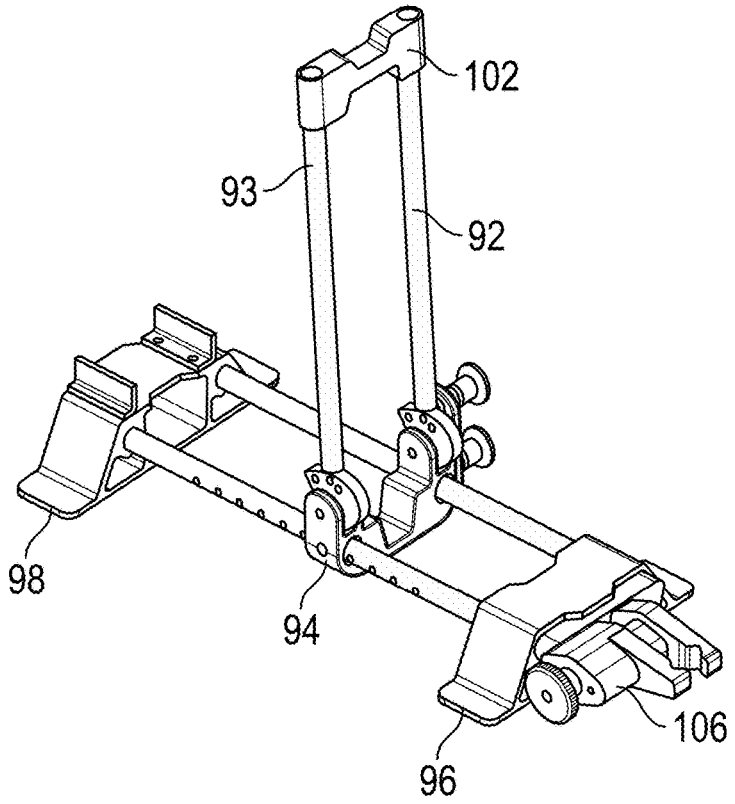

FIGS. 12 and 13 are schematic perspective views of embodiment 300 illustrating left and right support bars 92, 93 in the stowed and locked position (FIG. 12) and illustrating the support bars locked in position suitable for receiving a bicycle tire or wheel (FIG. 13). Repair mount 106 is also illustrated in stowed position.

Figure 15:
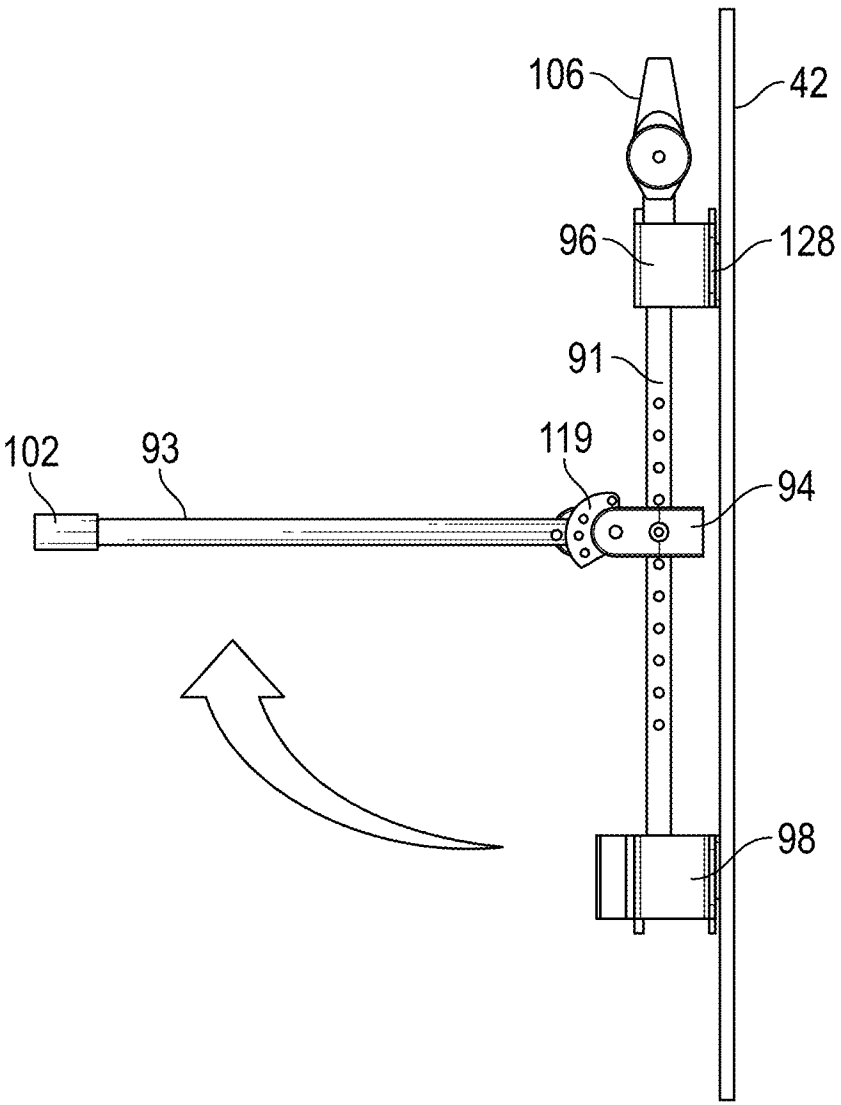
FIGS. 14 and 15 are schematic side views of the apparatus of FIGS. 9-13 attached to a wall or other support, with the repair mount stowed.
Figure 14:
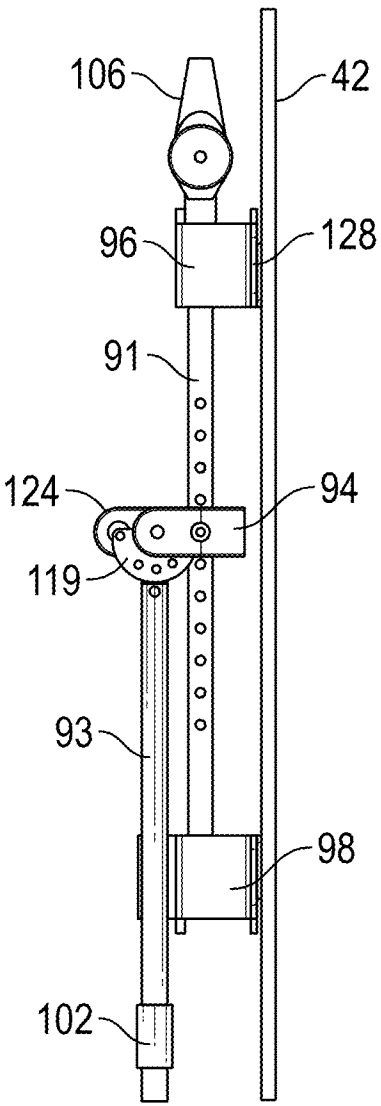

FIGS. 14 and 15 are schematic side views of apparatus embodiment 300 attached to a wall 42 or other support, with repair mount 106 stowed. The arrow in FIG. 15 indicates how support bars 92, 93 (only 93 is illustrated) may be swung up from a stowed position (FIG. 14) to a use position (FIG. 15). Locking pin 120 (FIG. 12) locks support bars 92, 93 in substantially horizontal position, which locking pin 122 locks center guide 94 (and thus support arms 92, 93) in height along positioning rails 90, 91.

Figure 16:
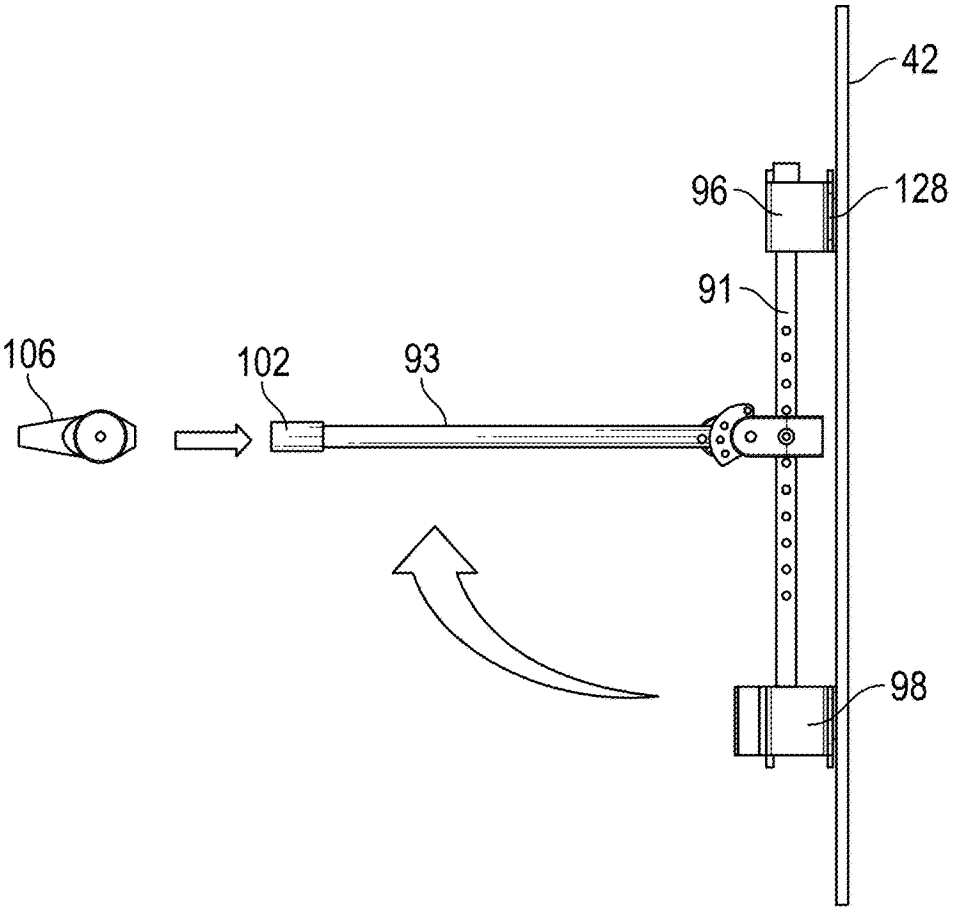
FIG. 16 is a schematic side view of the apparatus of FIGS. 9-15 attached to a wall or other support, with the repair mount detached from the stowed position and being attached to the tire holder for using the apparatus as a repair stand.

FIG. 16 is a schematic side view of apparatus embodiment 300 attached to a wall 42 or other support, with repair mount 106 detached from the stowed position and being attached to tire holder 102 (as indicated by the horizontal arrow) for using the apparatus as a bicycle repair stand.

Figure 17:
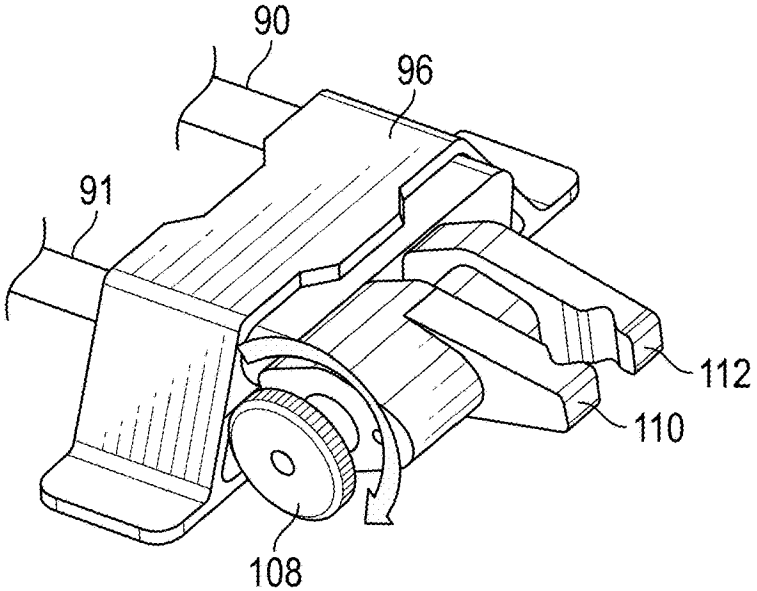
FIGS. 17 and 18 are schematic perspective and plan views, respectively, of the repair mount.
Figure 18:
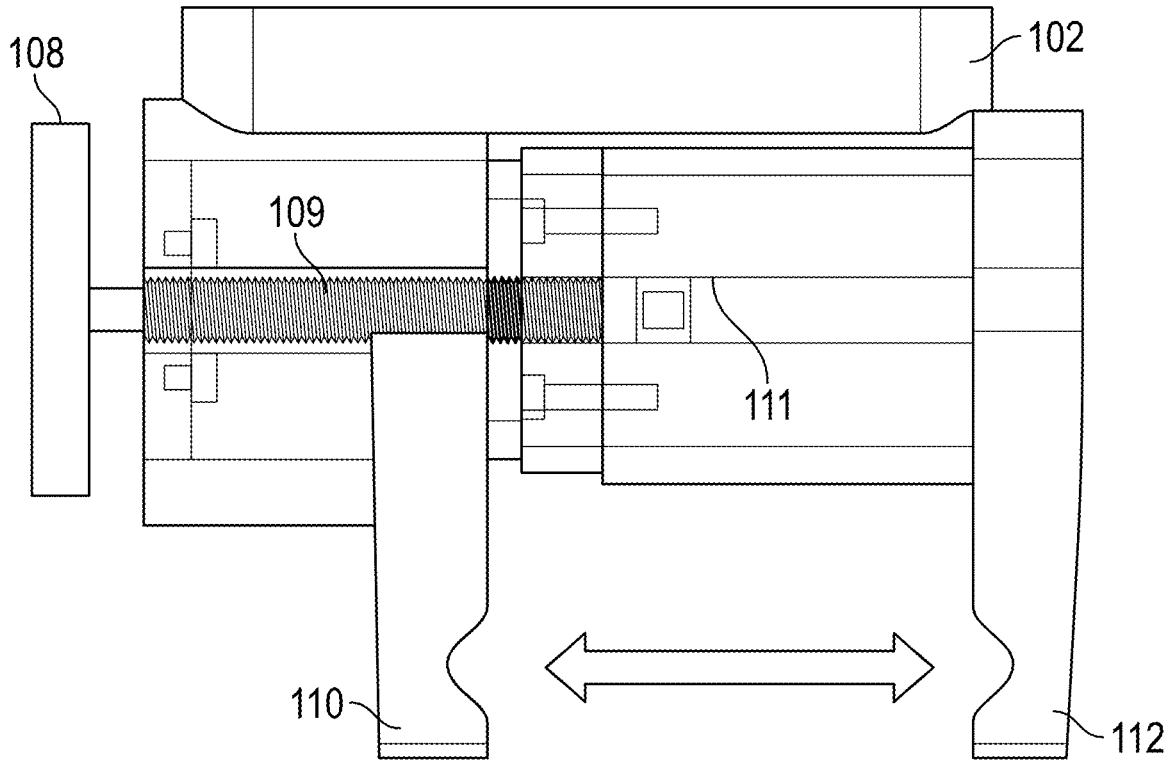
Figure 19:
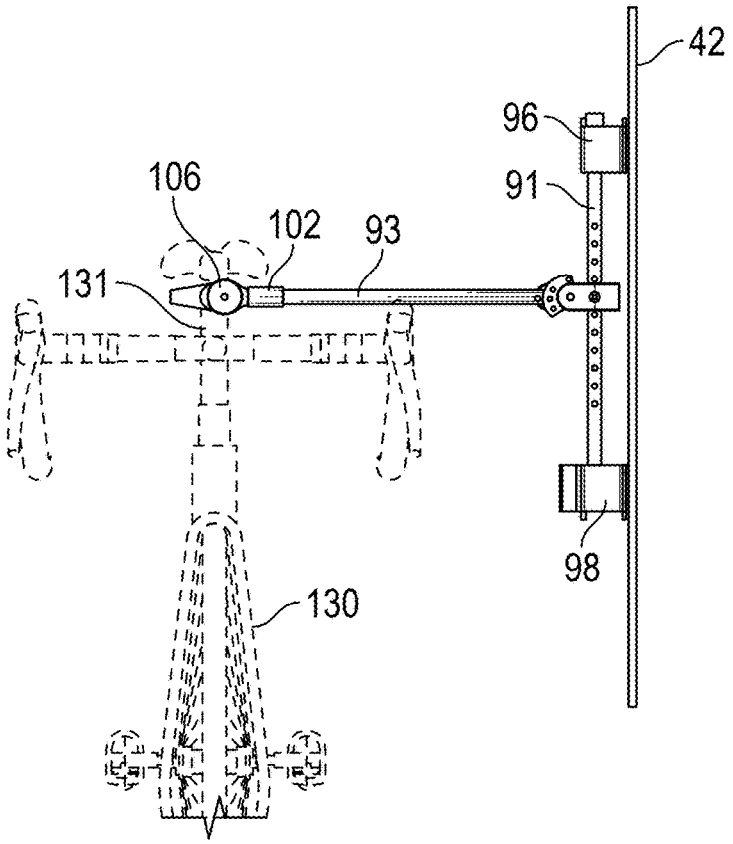
FIG. 19 is a side view of the apparatus with a bicycle clamped in to the repair mount.

FIGS. 17 and 18 are schematic perspective and plan views, respectively, of repair mount 106 of embodiment 300, and FIG. 19 is a side view of apparatus embodiment 300 with a bicycle seat post 131 (or other bicycle frame part) clamped into repair mount 106. The arcuate arrow in FIG. 17 indicates one possible rotational movement of knob 108, while the double-headed arrow in FIG. 18 indicates how adjustable clamp 112 may be moved into and out of clamping position with stationary clamp 110.

Figure 20:
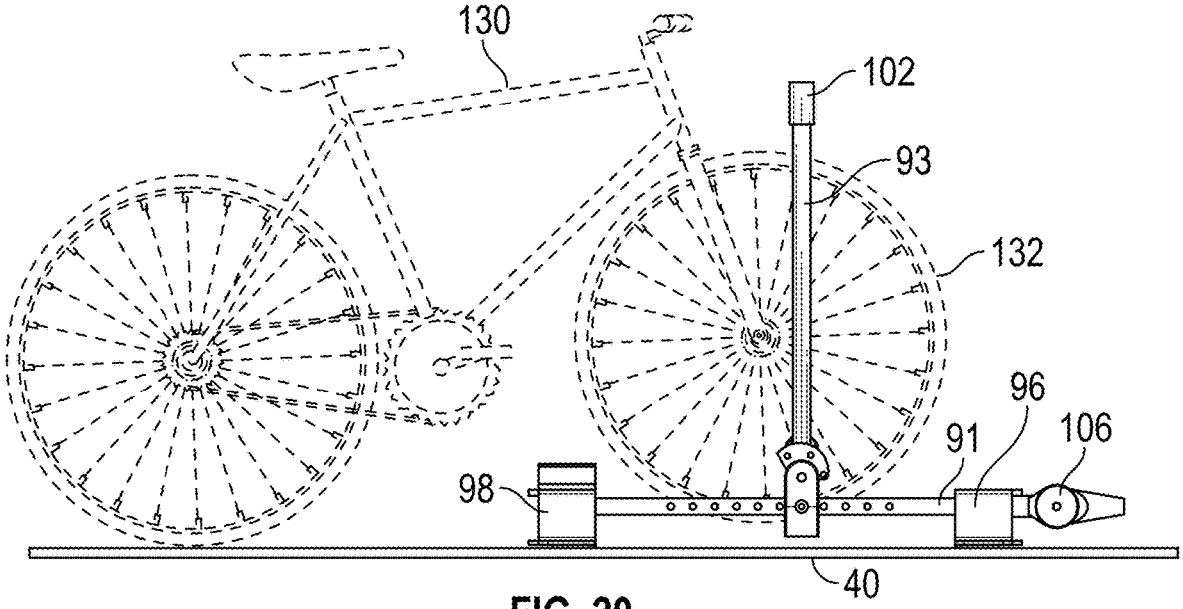
FIG. 20 is a schematic side view of the apparatus of FIGS. 9-16 and 19 employed as a floor or sidewalk bicycle rack.

FIG. 20 is a schematic side view of apparatus embodiment 300 employed as a floor, sidewalk, or other substantially horizontal surface 40 bicycle stand, illustrating a bicycle 130 in phantom as it is not a component of the present disclosure.

Figure 22:
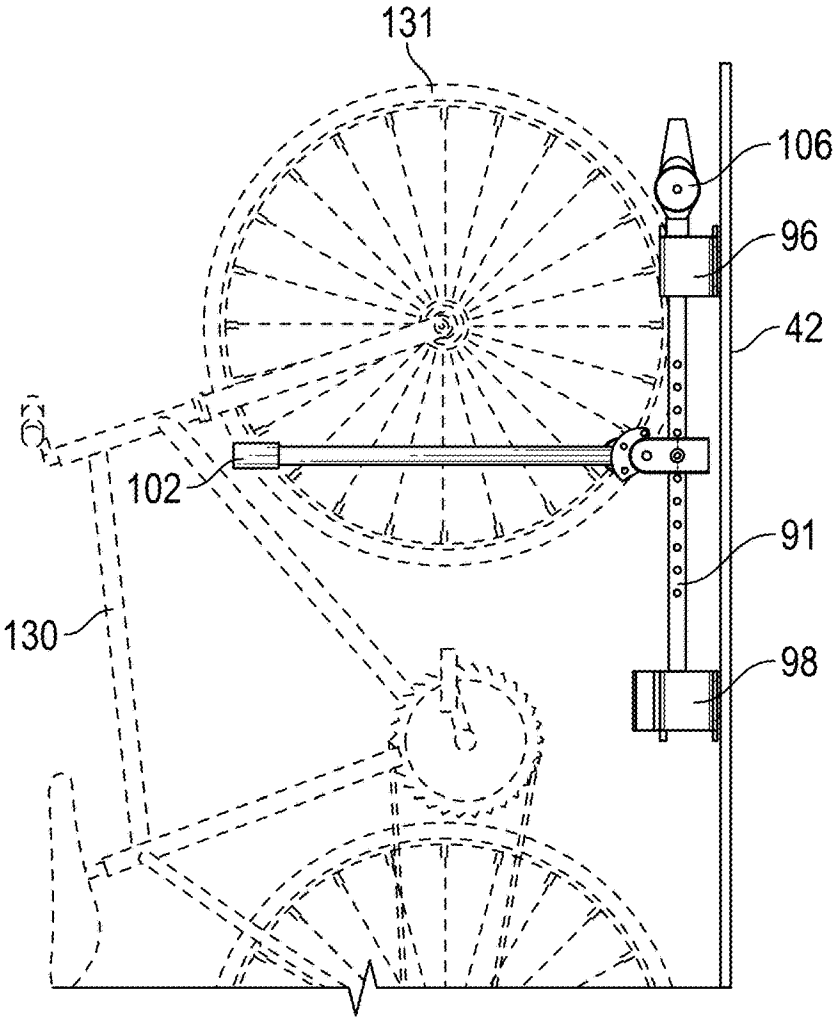
FIGS. 21 and 22 are schematic side views of the apparatus of FIGS. 9-16 and 19-20 employed as a floor or sidewalk bicycle rack.
Figure 21:
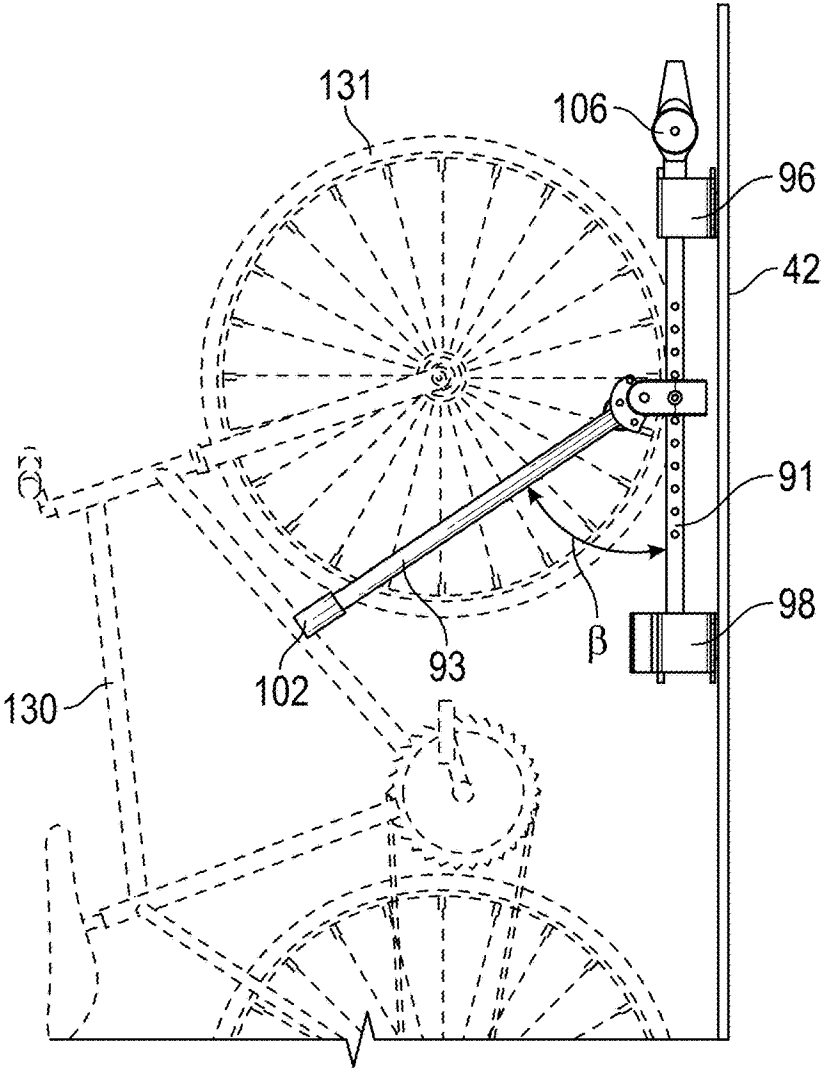

FIGS. 21 and 22 are schematic side views of apparatus embodiment 300 employed as a bicycle storage rack on a wall or other substantially vertical structure 42. FIG. 21 illustrates that support bars 92, 93 may be locked into position at an angle "β", which may range from 90 degrees to 0 degrees. For example, angle β may be 30 degrees, or 45 degrees, or 60 degrees, or 75 degrees.

Figure 23:
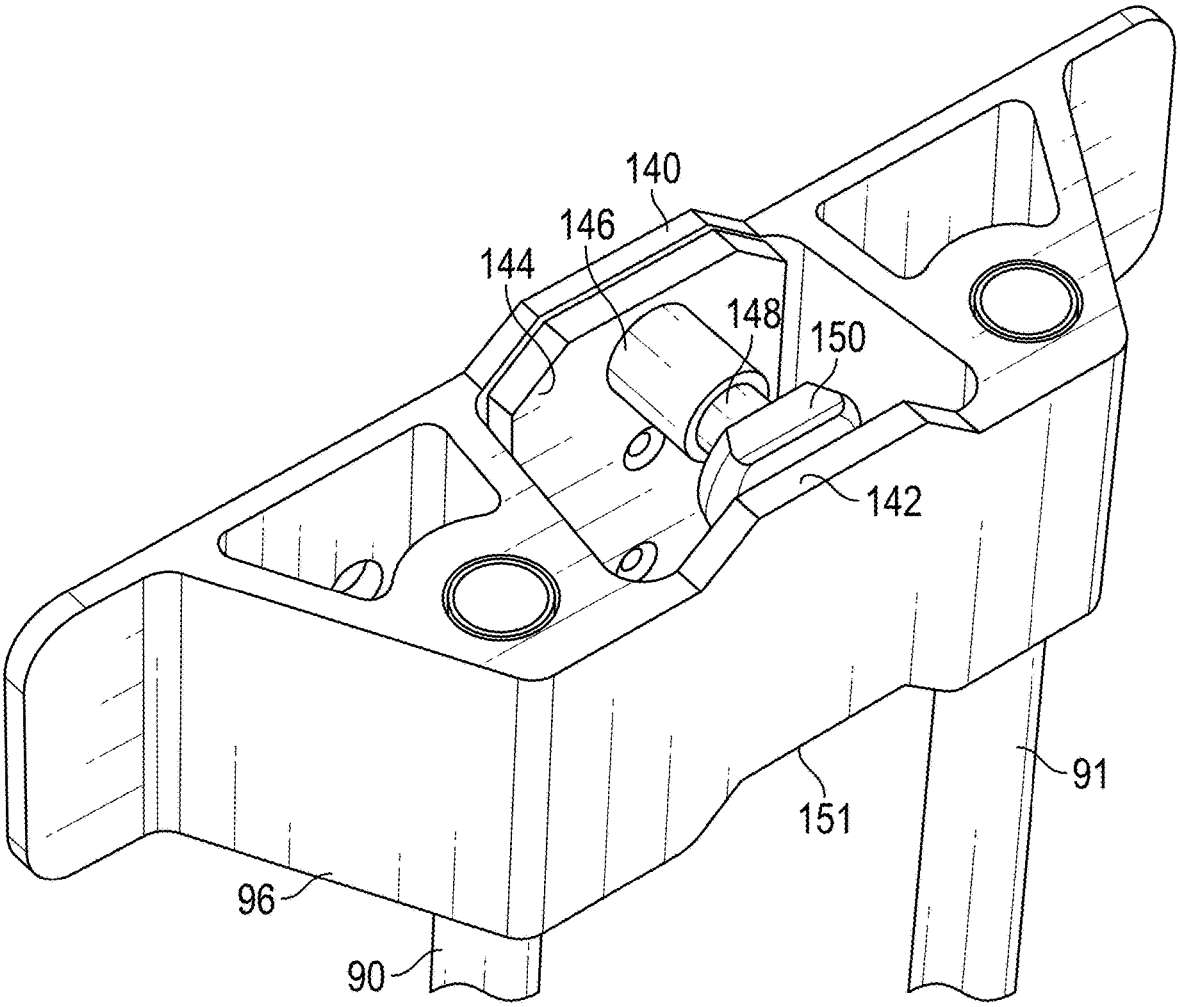
FIG. 23 is a schematic perspective view of a locking push/pull mechanism that may be employed to secure certain apparatus embodiments to a wall or other support.

FIG. 23 is a schematic perspective view of a locking push/pull mechanism that may be employed to secure certain apparatus embodiments to a wall or other support. This embodiment includes lower and upper extensions 140, 142 on front stability bar 96, and a strengthening bracket 144 welded or machined to front stability bar 96, adjacent lower extension 140 and extending the width of front stability bar 96. A pin housing 146 houses a push/pull pin 148 having a knob 150 that is mostly hidden from site but still accessible with one hand, where pulling pin 148 releases the apparatus from the wall. A notch 151 may be provided for accommodating bicycle a tire or wheel.

Figure 24:
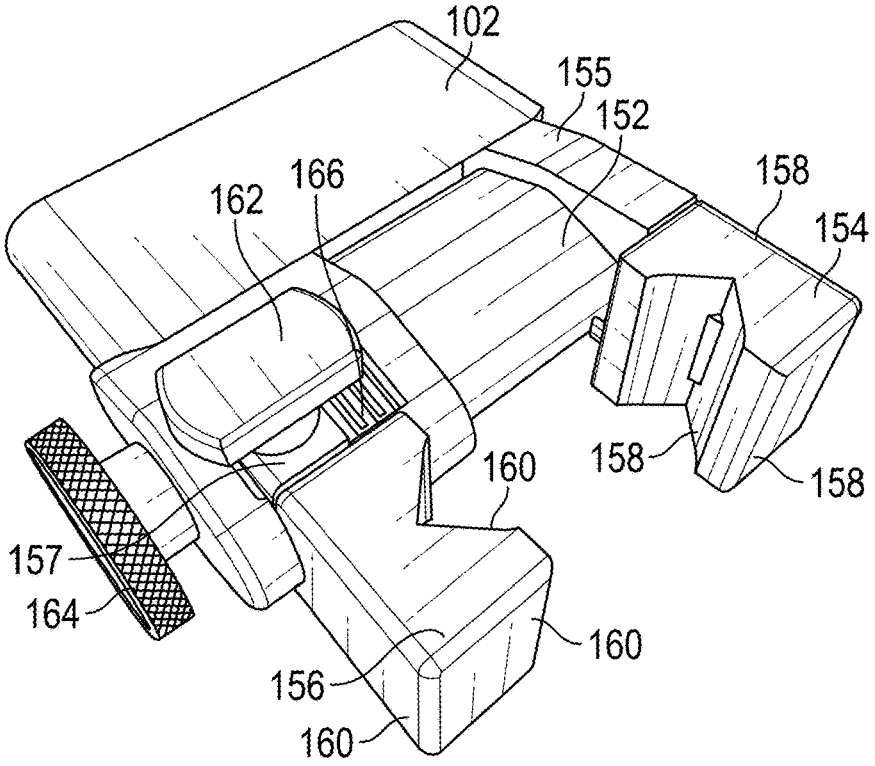
FIGS. 24 and 25 are schematic perspective views of an alternative repair clamp mechanism, featuring macro- and micro-adjustments with a locking pin.
Figure 25:
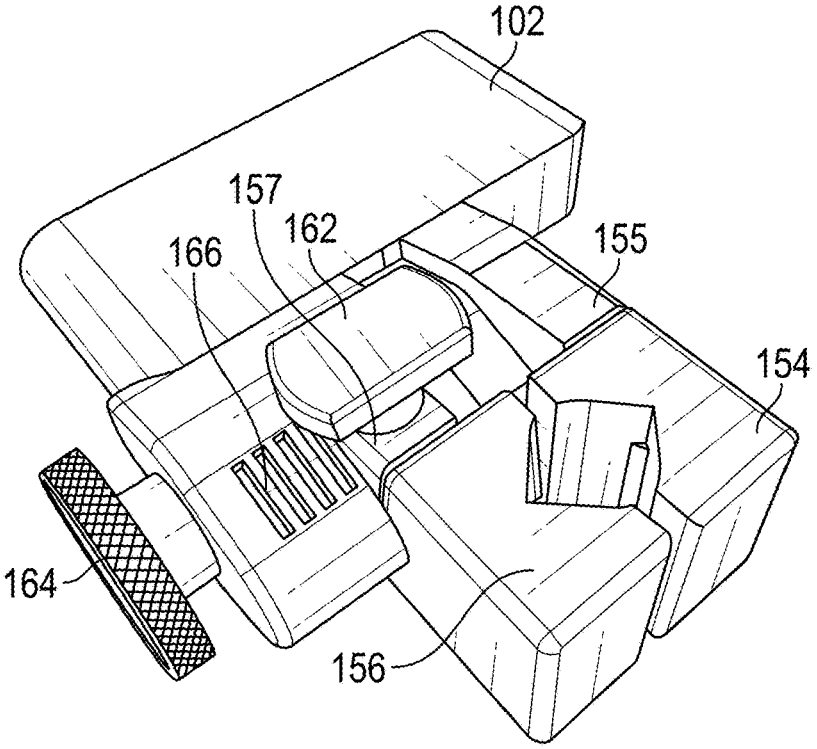

FIGS. 24 and 25 are schematic perspective views of an alternative repair mount having a body 152 and featuring a micro-adjustment clamp arm 154 and a macro-adjustment clamp arm 156 with a repair clamp pull pin 162. Micro-adjustment clamp arm 154 includes a slidable engagement bracket 155, and macro-adjustment clamp arm 156 includes a slidable engagement bracket 157. Rubber padding 158, 160 may optionally be provided. A micro-adjustment knob 164 is provided, as well as at least two, or a series of macro-movement locking grooves 166. This arrangement may be provided for those desiring less knob-turning and quick release of the bicycle from the repair mount.

As may be seen, apparatus of the present disclosure may be constructed in several different embodiments. In certain embodiments apparatus of the present disclosure may be constructed to accept a bicycle of prescribed dimensions. In other embodiments, apparatus of the present disclosure may be constructed to accept a range of bicycle sizes having a variety of tire and wheel sizes for a bicycle stand. For example, with respect at least to embodiment 300 and similar embodiments, an apparatus may be constructed having a "rack opening" ranging from 23.5 inch to 27.5 inch (as measured by the length of pivotable support bars) to accommodate tires ranging from 1 to 3 inch width and 24 to 29 inch diameter tires, and convertible to a repair stand having pivotable support bar length of 21.5 inches (as measured from a wall to the connection between the repair clamp and distal ends of the pivotable support bars). As used herein "adjustable" and "adjusted" mean one or more of vertically, horizontally, rotationally about an axis, rotationally in a plane, orbitally, and the like. Legs 4, 5, 6, and 7 in embodiment 200 and like embodiments may be adjusted and optionally locked in place using bolts 54, 55, 56, and 57 to secure the frame in position to accept the width of bicycle tire/wheel desired. Marked graduations on the top surface of the frame legs and cross bars may be employed to give an indication of position of the legs.

In embodiments 100, 200, and similar embodiments, if the frame base components are tubular, in certain embodiments the fork arms may be nominal 0.5 in. diameter tubing, and have a length ranging from about 25 to about 35 inches. The legs may be 1 inch tubing and have a length from about 5 to about 10 inches. In certain embodiments the angled supports may be 0.75 or 0.5 inch diameter tubing, and have length ranging from about 8 to about 12 inches. In certain embodiments the clip may be a piece of angle iron or steel having a length of about 2.5 to about 4 inches, with the legs of the clip being from about 0.5 inch to about 1 inch in length. In embodiment 300 and similar embodiments, support arms and positioning rails may be tubular, and in certain embodiments may be nominal 0.5 inch diameter tubing, and have a length ranging from about 25 to about 35 inches. (As used herein, "tubular" need not necessitate circular cross-sections. Normally metals such as steel are employed, but other metals or alloys, such as titanium and titanium alloys may be used, as well as certain engineer plastics.) Stability bars, center guides, tire holders, repair mounts, pins, and brackets may be machined or molded metal, or in some embodiments engineered plastic.

What has not been recognized or realized is an apparatus that may be used both a as a bicycle stand and as a bicycle repair stand/workstation. Apparatus to accomplish this without significant cost is highly desirable. As explained previously, previous devices serve as either a bicycle stand or a bicycle repair stand or workstation, but not both.

Thus apparatus described herein provide a quick and safe way of repairing or maintaining bicycles, as well as allowing a user to store a bicycle in a bicycle stand or storage rack when the bicycle is not in use. As far as I am aware, there exists no device having a base frame and a pair of upright, substantially vertical arms that can function both as a bicycle stand, and that can also function as a bicycle repair stand by featuring a clip on the base frame or other fastener for easily hanging and removing the base frame of the device on a mating garage door hinge or other mating clip, providing the formerly upright arms as a sturdy, substantially horizontal plane for placing a bicycle thereon and working on the bicycle, with the arms including an adjustable clamp with screw or "twist" tightening feature that may be used as a clamp to secure the bicycle to the substantially horizontal arms.

From the foregoing detailed description of specific embodiments, it should be apparent that patentable apparatus are described. Although specific embodiments of the disclosure have been described herein in some detail, this has been done solely for the purposes of describing various features and aspects of the apparatus and is not intended to be limiting with respect to their scope. It is contemplated that various substitutions, alterations, and/or modifications, including but not limited to those implementation variations which may have been suggested herein, may be made to the described embodiments without departing from the scope of the appended claims. For example, one modification would be to take an existing bicycle stand structure and modify it to include legs and a clip, or push/pull pins thereon. Another modification would be for bicycle stand suppliers to supply stands with built-in legs and clips, or in a kit including a bicycle stand, with legs and a clip that may be added or not as the purchaser desires. Bicycle stand and repair apparatus of the present disclosure may include one or more feature selected from knurled knobs; tubing of sufficient strength and size to support a variety of bicycle sizes and weights; other attachments such as removing the fork and replacing it with storage clips, L-shaped legs, or U-shaped legs; the clip may include heavy double sided tape or hook and loop fasteners; a kit may include attachments selected from a small hand pump, a flashlight, a safety flare, or extra parts, bicycle repair tools, patch kit, and/or tire tube.

What is claimed is:

1. A bicycle stand and repair apparatus comprising:

left and right positioning rails and left and right pivotable support bars pivotable through an angle "β" to the left and right positioning rails ranging from 0 to 90 degrees, with a positionable center guide generally transverse to the left and right positioning rails and connecting the left and right positioning rails;

front and rear stability bars fixed to the left and right positioning rails;

a slidable tire holder having a tire holder notch, the slidable tire holder transversely connecting the left and right pivotable support bars, the slidable tire holder positionable from distal ends of the left and right pivotable support bars; and a repair mount that is configured to be temporarily stowed when the apparatus is in a stowed position or when the apparatus is used as a bicycle rack, the repair mount detachable from the stowed position and securable to the slidable tire holder and/or to the left and right pivotable support bars.

2. The bicycle stand and repair apparatus of claim 1 wherein the repair mount includes a body and featuring a micro-adjustment clamp arm and a macro-adjustment clamp arm with a repair clamp pull pin, the micro-adjustment clamp arm including a slidable engagement bracket, the macro-adjustment clamp arm including a slidable engagement bracket, with a micro-adjustment knob, as well as at least two, or a series of macro-movement locking grooves in the macro-adjustment clamp arm.

3. The bicycle stand and repair apparatus of claim 1 comprising a locking push/pull mechanism that is configured to be employed to secure the apparatus to a wall or other support, the apparatus comprising lower and upper extensions on the front stability bar, and a strengthening bracket welded or machined to the front stability bar, adjacent the lower extension and extending a width of the front stability bar, a pin housing and a push/pull pin carried therein having a knob that is mostly hidden from sight but still accessible with one hand, where pulling the push/pull pin releases the apparatus from the wall.

4. The bicycle stand and repair apparatus of claim 1 wherein the left and right positioning rails each comprise two or more adjustment detents or through-holes for positioning or repositioning the left and right pivotable support bars, the left and right pivotable support bars secured to left and right arcuate brackets that are in turn secured in respective left and right slots in the center guide.

5. The bicycle stand and repair apparatus of claim 4 wherein the left and right arcuate brackets comprise two or more positioning detents or through-holes that work with one or both of the left and right pivotable support bars and one or two positioning locking pin(s) that work with the two or more positioning detents or through-holes in the left and right arcuate brackets.

6. The bicycle stand and repair apparatus of claim 1 comprising positioning pin(s) and locking pin(s) supported by a support bracket welded to or molded into the center guide.

7. The bicycle stand and repair apparatus of claim 1 further comprising one or more slots machined or molded into bottoms of the front and/or rear stability bars to accept wedges, bolts, or other mating mechanisms installed in a wall or other structure to temporarily attach the apparatus to the wall or other structure.

8. The bicycle stand and repair apparatus of claim 1 wherein:

the repair mount temporarily attaches to and detaches from apparatus when in stowed position by a first fastener selected from a first set of one or more ball detents, a first set of snaps, and a first set of screws; and the repair mount temporarily attaches to and detaches from the apparatus when in bicycle repair position by a second fastener selected from a second set of one or more ball detents, a second set of snaps, and a second set of screws.

* * * * *